US010137681B2

(12) United States Patent
Yoshida

(10) Patent No.: US 10,137,681 B2
(45) Date of Patent: Nov. 27, 2018

(54) IMAGE PROCESSING APPARATUS GENERATING PRINT DATA INCLUDING DOT FORMATION STATES FOR RESPECTIVE PIXELS BY USING IMAGE DATA

(71) Applicant: BROTHER KOGYO KABUSHIKI KAISHA, Nagoya-shi, Aichi-ken (JP)

(72) Inventor: Yasunari Yoshida, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/350,419

(22) Filed: Nov. 14, 2016

(65) Prior Publication Data

US 2017/0151779 A1 Jun. 1, 2017

(30) Foreign Application Priority Data

Nov. 30, 2015 (JP) ..... 2015-234087

(51) Int. Cl.

| | |
|---|---|
| ***B41J 11/00*** | (2006.01) |
| ***B41J 2/045*** | (2006.01) |
| ***B41J 2/21*** | (2006.01) |

(52) U.S. Cl.

CPC ..... *B41J 2/04541* (2013.01); *B41J 2/04581* (2013.01); *B41J 2/04586* (2013.01); *B41J 2/04595* (2013.01); *B41J 2/04596* (2013.01); *B41J 2/2128* (2013.01); *B41J 11/0065* (2013.01)

(58) Field of Classification Search

CPC .. B41J 2/04541; B41J 11/0065; B41J 2/2128; B41J 2/04596; B41J 2/04581; B41J 2/04586; B41J 2/04595

See application file for complete search history.

(56) References Cited

U.S. PATENT DOCUMENTS

2005/0212840 A1* 9/2005 Iriguchi ..... B41J 2/04573 347/9
2007/0057985 A1* 3/2007 Saito ..... B41J 2/2128 347/15

FOREIGN PATENT DOCUMENTS

| | | |
|---|---|---|
| JP | 2000-094669 A | 4/2000 |
| JP | 2005-022404 A | 1/2005 |
| JP | 2007-038579 A | 2/2007 |

* cited by examiner

*Primary Examiner* — Yaovi M Ameh
(74) *Attorney, Agent, or Firm* — Merchant & Gould P.C.

(57) ABSTRACT

In an image processing apparatus, a controller generates print data using target image data. The print data represents dot formation states classified for respective pixels. Each dot formation state is classified into a one of a plurality of dot types. The controller determines a dot type from a plurality of dot types including a first type dot and second type dot. The first type dot is formed by a first process for supplying a pressure applying section with a specific signal. The second type dot is formed by a second process that is not for supplying the pressure applying section with the specific signal. The first type dot is to be formed in an edge printing area. The first type dot is not to be formed but the second type dot is to be formed in an interior printing area.

10 Claims, 10 Drawing Sheets

IMAGE PROCESSING APPARATUS GENERATING PRINT DATA INCLUDING DOT FORMATION STATES FOR RESPECTIVE PIXELS BY USING IMAGE DATA

CROSS REFERENCE TO RELATED APPLICATION

This application claims priority from Japanese Patent Application No. 2015-234087 filed Nov. 30, 2015. The entire content of the priority application is incorporated herein by reference.

TECHNICAL FIELD

The present disclosure relates to a technology for printing images by ejecting ink droplets onto a recording sheet to form dots.

BACKGROUND

There is a conventional image-forming technique called borderless recording in which an image can be recorded over the entire surface of a recording medium so that no unprinted margins remain along the edges. In borderless recording, ink droplets are ejected over a range larger than the recording medium.

SUMMARY

In the borderless recording, some of the ink droplets generate mist that permeates the recording apparatus. Mist that permeates the recording apparatus may cause a variety of problems. For example, the mist may become deposited on conveying rollers and subsequently transferred onto and staining recording media. Such mist is more likely to be generated when ejecting small ink droplets in areas outside the recording medium. Therefore, techniques have been proposed for reducing the frequency in which ink droplets for forming dots with a small diameter are ejected when recording in areas near the edges of the recording medium.

However, these conventional techniques do not go far enough in suppressing problems caused by small ink droplets.

In view of the foregoing, it is an object of the present disclosure to provide a technique for suppressing problems caused by small ink droplets.

In order to attain the above and other objects, the disclosure provides an image processing apparatus. The image processing apparatus includes a controller configured to perform: acquiring target image data; generating print data using the target image data, the print data representing dot formation states for respective pixels in a printing area, the printing area including an edge printing area and an interior printing area inside the edge printing area, the edge printing area including an outer area outside a recording sheet; and supplying the print data to a print execution machine, the print execution machine including a plurality of nozzles configured to eject ink droplets; a pressure applying section configured to apply pressure to ink to eject the ink droplets; and a drive section configured to supply a pulse signal to drive the pressure applying section. The generating print data includes determining a dot type from a plurality of dot types including a first type dot and second type dot. Each of the dot formation states is classified into one of the plurality of dot types. The first type dot is formed by a first process.

The first process is for supplying the pressure applying section with a specific drive pulse signal so as not to generate small ink droplet. The second type dot is formed by a second process. The second process being not for supplying the pressure applying section with the specific drive pulse signal. The determining determines that the first type dot is to be formed in the edge printing area. The determining determines that the first type dot is not to be formed but the second type dot is to be formed in the interior printing area.

According to another aspects, the disclosure provides a non-transitory computer readable storage medium storing a set of program instructions installed on and executed by a computer. The set of program instructions includes: acquiring target image data; generating print data using the target image data, the print data representing dot formation states for respective pixels in a printing area, the printing area including an edge printing area and an interior printing area inside the edge printing area, the edge printing area including an outer area outside a recording sheet; and supplying the print data to a print execution machine, the print execution machine including a plurality of nozzles configured to eject ink droplets; a pressure applying section configured to apply pressure to ink to eject the ink droplets; and a drive section configured to supply a pulse signal to drive the pressure applying section. The generating print data includes determining a dot type from a plurality of dot types including a first type dot and second type dot. Each of the dot formation states is classified into one of the plurality of dot types. The first type dot is formed by a first process. The first process is for supplying the pressure applying section with a specific drive pulse signal so as not to generate small ink droplet. The second type dot is formed by a second process. The second process being not for supplying the pressure applying section with the specific drive pulse signal. The determining determines that the first type dot is to be formed in the edge printing area. The determining determines that the first type dot is not to be formed but the second type dot is to be formed in the interior printing area.

BRIEF DESCRIPTION OF THE DRAWINGS

The particular features and advantages of the disclosure as well as other objects will become apparent from the following description taken in connection with the accompanying drawings, in which.

DETAILED DESCRIPTION

A. First Embodiment

A-1. Structure of a Printing Apparatus

Figure 1:
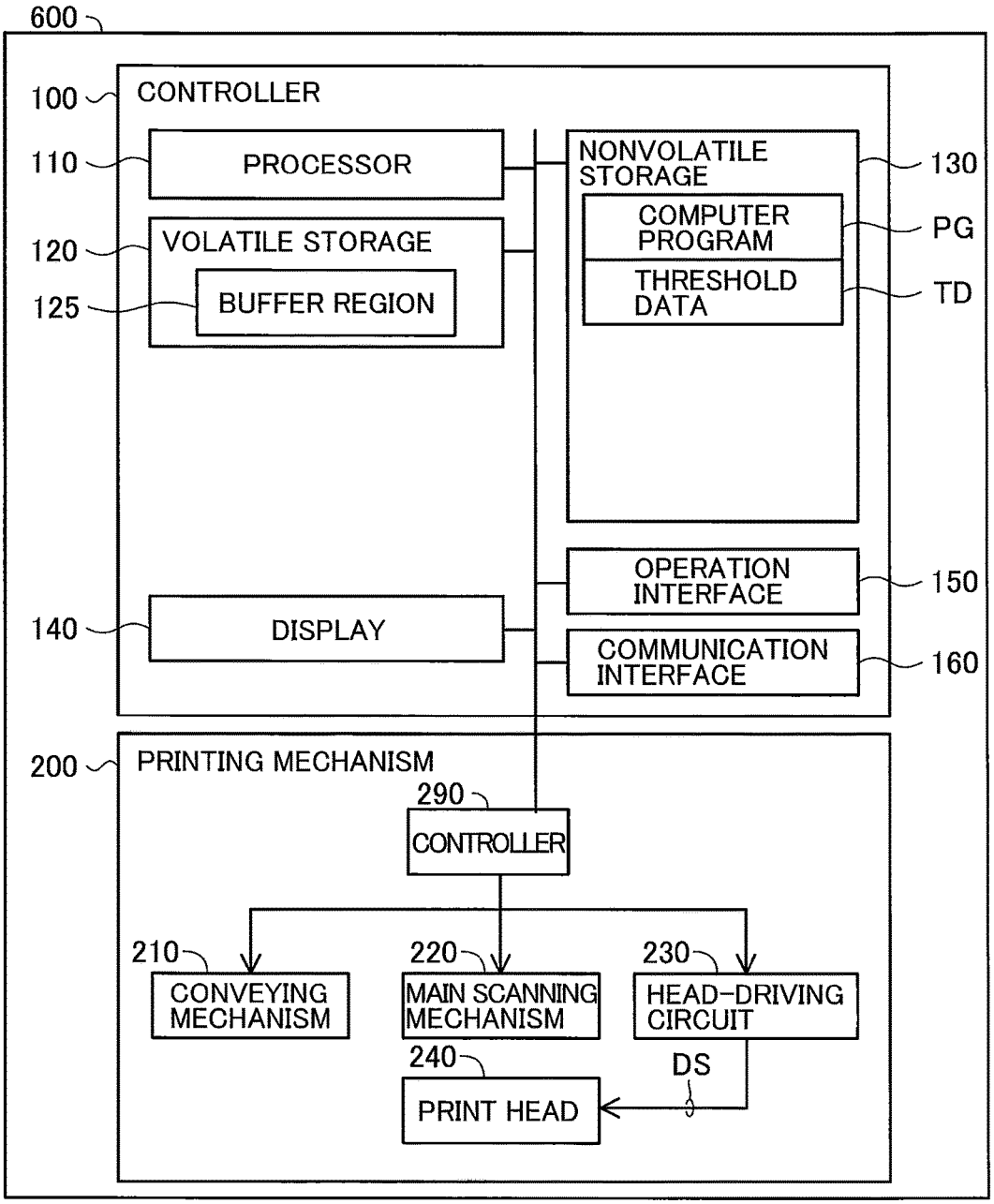
FIG. 1 is a block diagram showing a structure of a printer according to a first embodiment.

FIG. 1 is a block diagram showing the structure of a printer 600 according to a first embodiment. The printer 600 is an inkjet printer that prints images on sheets of paper by forming dots on the paper with ink. The printer 600 includes a controller 100 for controlling all operations of the printer 600, and a printing mechanism 200 serving as the print execution machine.

The controller 100 includes a processor 110 (a CPU, for example) for processing data; a volatile storage 120, such as DRAM; a nonvolatile storage 130, such as flash memory or a hard disk drive; a display 140, such as a liquid crystal display; an operation interface 150 including a touchscreen superimposed on the display 140, various buttons, and the like; and a communication interface 160 for communicating with external apparatuses, such as a personal computer (not shown). These components are interconnected via a bus.

The volatile storage 120 is provided with a buffer region 125 for temporarily storing various intermediate data generated when the processor 110 performs processes. The nonvolatile storage 130 stores threshold data TD and a computer program PG for controlling the printer 600. The processor 110 implements a printing process described later by executing the computer program PG. The threshold data TD is referenced during an error diffusion process described later. The computer program PG and the threshold data TD are pre-stored in the nonvolatile storage 130 prior to shipping the printer 600. Note that the computer program PG and the threshold data TD may be supplied to the user on a DVD-ROM or other storage medium, or may be made available for download from a server. The threshold data TD may also be incorporated with the computer program PG.

The printing mechanism 200 can perform printing operations by ejecting ink in the colors cyan (C), magenta (M), yellow (Y), and black (K) under control of the processor 110 in the controller 100. The printing mechanism 200 includes a conveying mechanism 210, a main scanning mechanism 220, a head-driving circuit 230, a print head 240, and a controller 290 that controls these components. The conveying mechanism 210 is provided with a conveying motor (not shown) that produces a drive force for conveying sheets of paper along a prescribed conveying path. The main scanning mechanism 220 is provided with a main scanning motor (not shown) that produces a drive force for reciprocating the print head 240 in a main scanning direction (hereinafter also called a "main scan"). The head-driving circuit 230 provides a drive signal DS to the print head 240 for driving the print head 240 while the main scanning mechanism 220 is moving the print head 240 in a main scan. The print head 240 forms dots on a sheet of paper conveyed by the conveying mechanism 210 by ejecting ink according to the drive signal DS. The controller 290 is an electronic circuit that includes an integrated circuit designed for a special application, such as an application-specific integrated circuit (ASIC). The controller 290 controls the components of the printing mechanism 200 on the basis of print data received from the controller 100. In this description, the process of forming dots on paper while performing a main scan will be called a "pass process." The processor 110 of the controller 100 executes printing by repeatedly controlling the printing mechanism 200 to execute a conveying process for conveying the sheet in the conveying direction with the conveying mechanism 210, and a pass process for forming dots on the sheet using the main scanning mechanism 220 and the head-driving circuit 230.

Figure 2A:
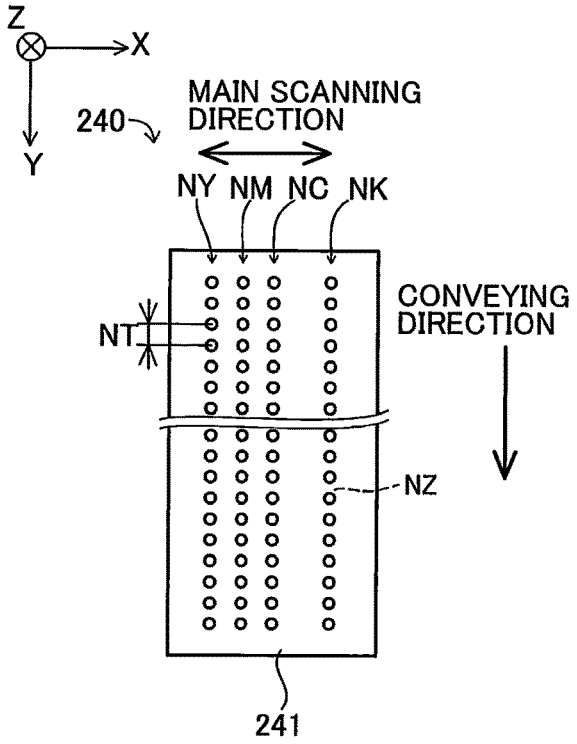
FIG. 2(A) is an explanatory diagram showing a general configuration of a nozzle-forming surface.

The print head 240 has a nozzle-forming surface 241. FIG. 2(A) shows the general configuration of the nozzle-forming surface 241. In FIG. 2(A), the nozzle-forming surface 241 constitutes the −Z side surface of the print head 240. Nozzle rows NC, NM, NY, and NK for ejecting ink droplets in the respective colors C, M, Y, and K are formed in the nozzle-forming surface 241. Each nozzle row includes a plurality of nozzles NZ spaced at a prescribed nozzle pitch NT in the conveying direction so that the space between any two neighboring nozzles NZ in the conveying direction is equal. The positions of the plurality of nozzles NZ in a single nozzle row relative to the main scanning direction may be the same or different. For example, the nozzles NZ in one row may be arranged in a pattern that zigzags when progressing in the conveying direction. In FIG. 2 and subsequent drawings, the +Y direction denotes the conveying direction (sub scanning direction), the X direction denotes the main scanning direction, and the +Z direction denotes a direction orthogonal to the Y direction and X direction (the upward direction in this example). Hereinafter, the +Y side will simply be called the "downstream side," while the −Y side will simply be called the "upstream side."

Figure 2B:
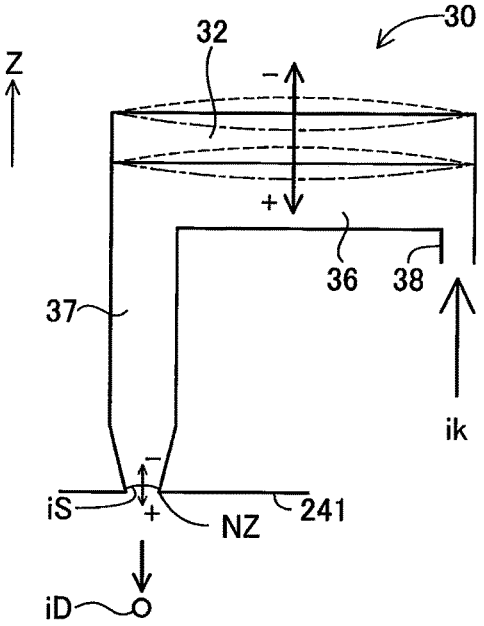
FIG. 2(B) is a schematic diagram of an ejection section that forms a single nozzle.

FIG. 2(B) is a schematic diagram of an ejection section 30 that forms a single nozzle NZ. The ejection section 30 includes a pressure chamber 36, a nozzle channel 37 connecting the pressure chamber 36 to a nozzle NZ formed in the nozzle-forming surface 241, a supply channel 38 connected to the pressure chamber 36 at a different position from the nozzle channel 37, and a piezoelectric element 32 forming a portion of the pressure chamber 36. An ink tank (not shown) is connected to the supply channel 38. Ink ik is supplied from the ink tank into the pressure chamber 36 and the nozzle channel 37 through the supply channel 38. The surface of the ink ik in the region of the nozzle NZ formed in the nozzle channel 37 constitutes an ink surface iS. In the following description, the nozzle channel 37 having the nozzle NZ formed in one end thereof will be called the nozzle part 37.

The piezoelectric element 32 can expand or contract the pressure chamber 36 through deflection in response to the drive signal DS provided by the head-driving circuit 230. When the pressure chamber 36 is contracted, pressure is applied to the ink ik in the nozzle part 37 in a direction for forcing the ink ik out through the nozzle NZ. Due to this pressure, the ink surface iS moves toward the exterior of the nozzle NZ until an ink droplet iD is ejected from the nozzle NZ. When the pressure chamber 36 is expanded, pressure is applied to the ink ik in the nozzle part 37 in a direction from the nozzle NZ toward the interior of the nozzle part 37. In this way, the piezoelectric element 32 operates as a pressure-applying unit for applying pressure to the ink ik.

In FIG. 2(B), the "+" symbol denotes the direction in which the piezoelectric element 32 is deflected in order to constrict the pressure chamber 36 (i.e., reduce the volume of the pressure chamber 36), and the "−" symbol denotes the direction in which the piezoelectric element 32 is deflected in order to expand the pressure chamber 36 (i.e., increase the volume of the pressure chamber 36). The "+" also denotes the direction in which the ink surface iS moves when being forced out of the nozzle part 37, while the "−" denotes the opposite direction.

A-2. The Printing Area PA and Structure of the Conveying Mechanism 210

Figure 3:
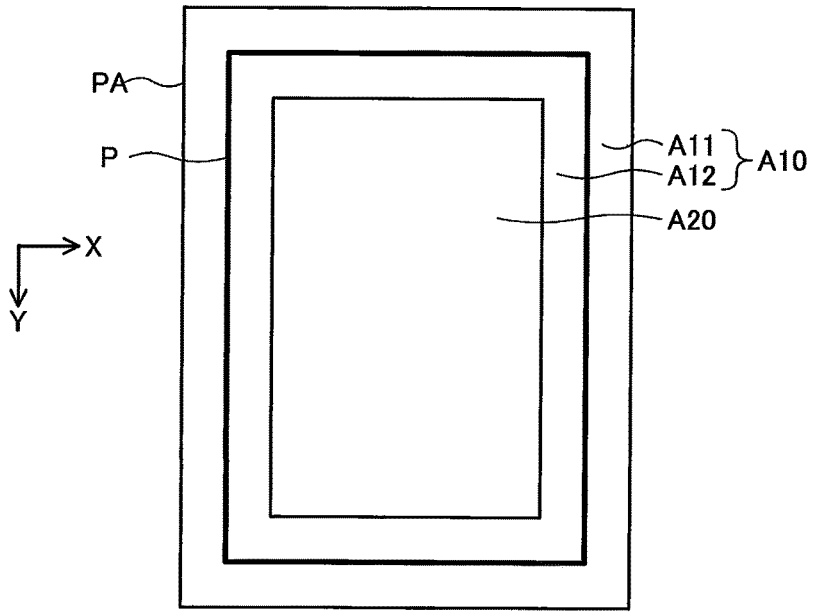
FIG. 3 is an explanatory diagram showing a sheet of paper and a printing area.

FIG. 3 is an explanatory diagram showing a sheet P of paper (an example of the printing medium), and a printing area PA. The edges of the sheet P are depicted with bold lines in FIG. 3. The printing area PA is the area in which the printing mechanism 200 of the printer 600 can eject ink droplets. In the embodiment, the printing area PA includes the entire area of the sheet P, and an outer area A11 constituting an area outside the sheet P. The outer area A11 is adjacent to the edges of the sheet P around the entire perimeter of the same. Thus, the printing area PA is larger than the sheet P and includes the entirety of the sheet P. The printing mechanism 200 can eject ink droplets iD over the entire printing area PA. Accordingly, the printing mechanism 200 can execute borderless printing for printing images up to the edges of the sheet P so that no unprinted margins remain along the edges.

As shown in FIG. 3, the area of the sheet P is divided into a first area A12 constituting the perimeter region of the sheet P that includes the edges of the sheet, and a second area A20 constituting the center region of the sheet P surrounded by the first area A12. The first area A12 is provided along all edges of the sheet P. Hereinafter, the entirety of the outer area A11 and the first area A12 together will be called the "edge printing area A10." Further, the second area A20 will be called the "interior printing area A20."

Figure 4A:
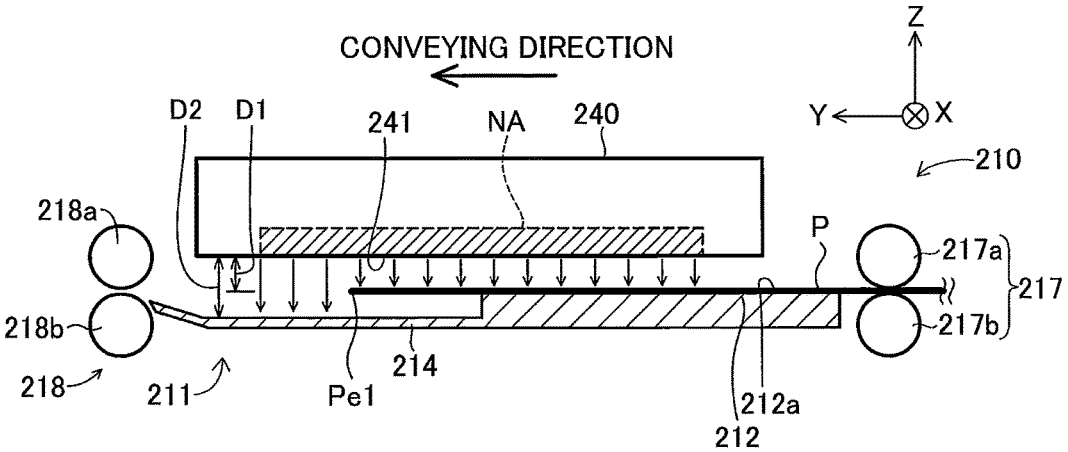
FIGS. 4(A)-4(C) are side schematic diagrams of a conveying mechanism.
Figure 4B:
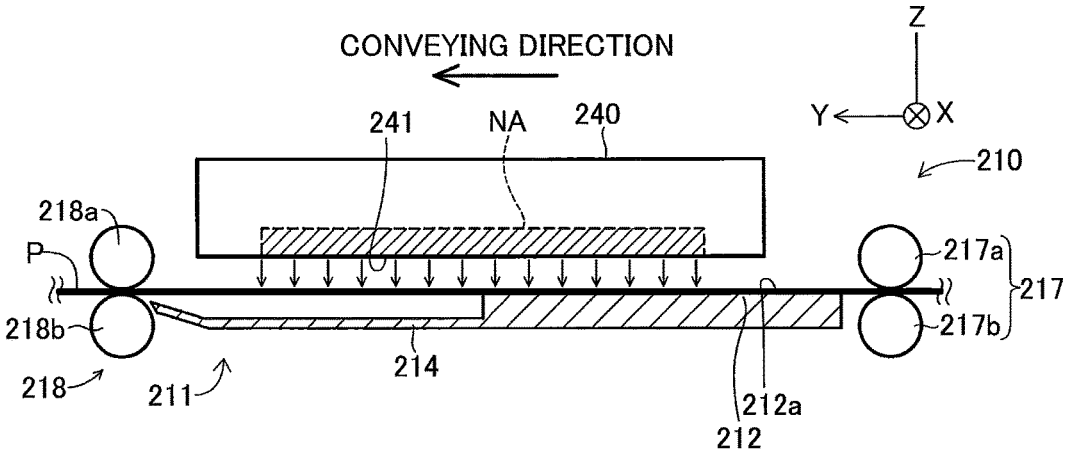
Figure 4C:
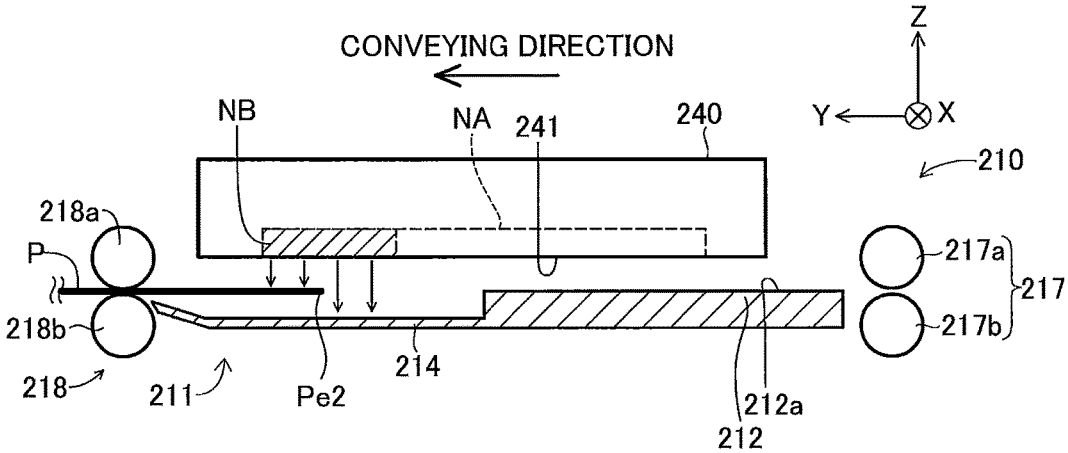

The conveying mechanism 210 (see FIG. 1) is capable of performing borderless printing. FIGS. 4(A)-4(C) are a side schematic diagram of the conveying mechanism 210. Conveyance of a sheet P proceeds in the sequence illustrated by FIGS. 4(A), 4(B), and 4(C). As shown in the drawings, the conveying mechanism 210 includes a platen 211, and pairs of upstream rollers 217 and downstream rollers 218 for holding and conveying sheets. The print head 240 is disposed above (on the +Z side of) the platen 211.

The upstream rollers 217 are disposed on the upstream side (−Y side) of the print head 240 in the conveying direction, while the downstream rollers 218 are disposed on the downstream side (+Y side) of the print head 240. The upstream rollers 217 include a drive roller 217*a*, and a follow roller 217*b*. The drive roller 217*a* is driven to rotate by a conveying motor (not shown). The follow roller 217*b* rotates along with the rotation of the drive roller 217*a*. Similarly, the downstream rollers 218 include a drive roller 218*a*, and a follow roller 218*b*. Note that plate members may be employed in place of the follow rollers, whereby sheets of paper are held between the drive rollers and corresponding plate members.

The platen 211 is disposed at a position between the upstream rollers 217 and the downstream rollers 218 and confronts the nozzle-forming surface 241 of the print head 240. The platen 211 includes a flat plate 214, and a support member 212 provided on the flat plate 214. The flat plate 214 is a plate-shaped member that is arranged substantially parallel to the main scanning direction (X direction) and the conveying direction (+Y direction). The edge of the flat plate 214 on the −Y side is positioned near the upstream rollers 217 and extends farther in the −Y direction than the −Y side end of the print head 240. The edge of the flat plate 214 on the +Y side is positioned near the downstream rollers 218 and extends farther in the +Y direction than the +Y side end of the print head 240.

The support member 212 is a rib-like member that extends in the Y direction and protrudes in the +Z direction from the flat plate 214. While not shown in the drawings, a plurality of the support members 212 is arranged on the flat plate 214 in the embodiment so as to be spaced at intervals in the X direction. The −Y end of each support member 212 is flush with the −Y edge of the flat plate 214, and the +Y end of each support member 212 is positioned in the center region of the flat plate 214 relative to the Y direction. The +Y end of each support member 212 may be said to be positioned in the center region of a nozzle area NA relative to the Y direction, where the nozzle area NA is the region in which the plurality of nozzles NZ is formed in the print head 240. Each support member 212 has a support surface 212*a* on which the sheet P is supported.

At the stage of conveyance shown in FIG. 4(A), a downstream (+Y) edge Pe1 of the sheet P is positioned between the nozzle area NA and the platen 211 and to the +Y side of the support members 212. In this state, all nozzles in the nozzle area NA (i.e., all nozzles formed in the print head 240) are used in printing. At this time, ink droplets ejected from the nozzles in the nozzle area NA form dots on the sheet P on the upstream side (−Y side) from the downstream edge Pe1 of the sheet P. On the other hand, ink droplets ejected from nozzles in the nozzle area NA that are outside (downstream or on the +Y side of) the downstream edge Pe1 of the sheet P land on the flat plate 214 rather than the sheet P. In this way, the printer 600 can print an image over the entire sheet P from the interior of the sheet P up to and including the downstream edge Pe1 of the sheet P, without leaving an unprinted margin near the downstream edge Pe1.

At the stage of conveyance shown in FIG. 4(B), the sheet P is held by both the upstream rollers 217 and downstream rollers 218. In this state, the entire nozzle area NA confronts the sheet P. Thus, ink droplets ejected from all nozzles in the nozzle area NA form dots on the sheet P. In this state, the printer 600 can print an image in the interior area of the sheet P.

At the stage of conveyance shown in FIG. 4(C), an upstream (−Y) edge Pe2 of the sheet P is positioned between the nozzle area NA and the platen 211 on the +Y side of the support members 212. In this state, only nozzles in a partial region NB of the nozzle area NA that includes the downstream end (hereinafter called the "downstream partial region NB") are used in printing. The downstream partial region NB is the portion of the nozzle area NA positioned on the downstream side (+Y side) of the support members 212 constituting the platen 211. The upstream edge Pe2 of the sheet P is positioned between the upstream end and downstream end of the downstream partial region NB. Ink droplets ejected from nozzles in the downstream partial region NB at positions inside of the upstream edge Pe2 of the sheet P (the downstream side, or +Y side, in this case) form dots on the sheet P, while ink droplets ejected from nozzles in the downstream partial region NB at positions outside the upstream edge Pe2 of the sheet P (the upstream side, or −Y side, in this case) land on the flat plate 214 rather than the sheet P. Through this process, the printer 600 can print an image from the interior of the sheet P all the way to the upstream edge Pe2 of the sheet P without leaving an unprinted margin along the upstream edge Pe2.

As described above, the conveying mechanism 210 can record an image on the sheet P so that no unprinted margin remains on either edge of the sheet P relative to the Y direction. Further, the conveying mechanism 210 can record an image on the sheet P without leaving an unprinted margin on either edge of the sheet P in the X direction. While not shown in the drawings, the dimension of the flat plate 214 in the X direction is longer by a prescribed amount than the dimension of a sheet P of specific size being conveyed on the conveying path. Further, the support members 212 are positioned inside both edges of the sheet P relative to the X direction. In a single pass process, the print head 240 ejects ink droplets toward positions covering the entire sheet P in the X direction, beginning from the area outside one edge of the sheet P relative to the X direction (the outer area A11 in FIG. 3) and continuing across the entire width of the sheet P to the area outside the other edge of the sheet P relative to the X direction (the outer area A11). Ink droplets ejected inside the edges of the sheet P form dots on the sheet P. Ink droplets ejected toward outside the sheet P land on the flat plate 214 rather than the sheet P. Through this process, the print head 240 can print an image on the sheet P without leaving unprinted margins along the edges of the sheet P relative to the X direction.

A-3. Printing Process

Figure 5:
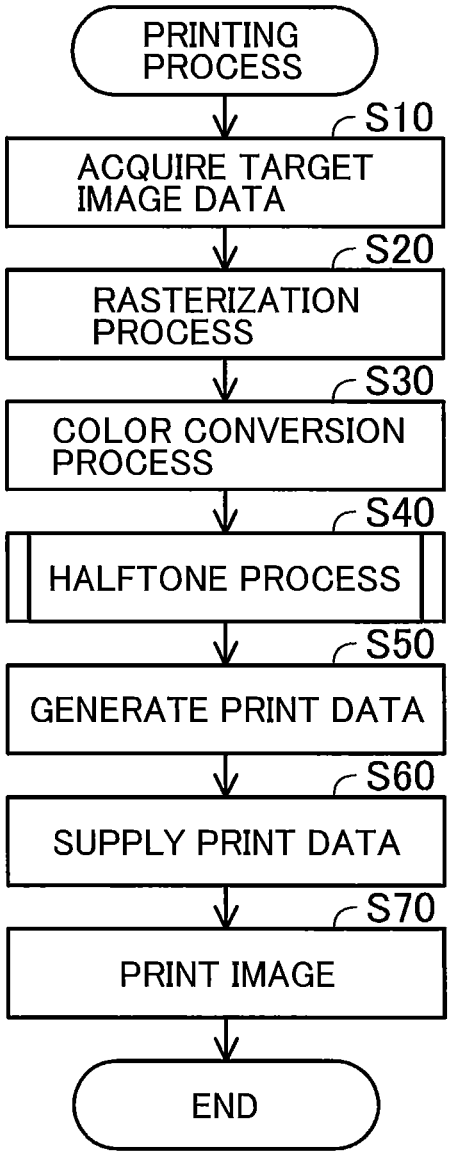
FIG. 5 is a flowchart illustrating steps in a printing process.

FIG. 5 is a flowchart illustrating steps in a printing process. The processor 110 of the controller 100 (see FIG. 1) executes a printing process for controlling the printing mechanism 200 to perform a printing operation on the basis of a print command received from the user. Here, the controller 100 may be considered an image processing apparatus for printing.

In S10 of FIG. 5, the processor 110 acquires a print command from the user via the operation interface 150. The print command includes an instruction specifying image data to be printed, and an instruction specifying a printing mode. In the embodiment, the printing mode is selected from "borderless printing" and "normal printing" modes. When normal printing has been selected, the processor 110 prints an image on the sheet P while leaving an unprinted margin along the edges of the sheet P. Hereinafter, a description of the printing process will be given for a case in which borderless printing has been selected.

In S10 the processor 110 also acquires the image data specified by the user. For example, the processor 110 may acquire image data from a storage, such as the nonvolatile storage 130. The image data may be data described in a page description language or data compressed in the JPEG format, for example.

In S20 the processor 110 executes a rasterization process on the image data acquired in S10 to generate bitmap data representing a target image having a plurality of pixels. The bitmap data is RGB image data representing the color of each pixel in RGB values. Each of the three component values included in the RGB values, i.e., each of the R value, G value, and B value, is a gradation value expressed in one of 256 gradations, for example.

In S30 the processor 110 executes a color conversion process on the RGB image data to generate image data corresponding to the types of ink used for printing on the printer 600. In the embodiment, the processor 110 generates CMYK image data. The CMYK image data represents a color for each pixel as gradation values for the four color components CMYK (hereinafter called the CMYK values). The color conversion process is performed using a lookup table that defines correlations between RGB values and CMYK values, for example.

In S40 the processor 110 executes a halftone process on the CMYK image data to generate dot data representing a dot formation state for each pixel and each ink color. In the embodiment, the halftone process is implemented by an error diffusion process using error matrices. In the embodiment, one of five types of dot formation states may be set for each pixel and each type of ink. These dot formation states include "no dot," "small dot," "medium dot," "large dot," and "special dot." The error diffusion process will be described later.

In S50 the processor 110 generates print data based on the dot data generated in S40. The print data is expressed in a data format that the controller 290 of the printing mechanism 200 can interpret. For example, the processor 110 generates print data by arranging the dot data in the order to be used in printing and by adding various printer control codes and data identification codes to the dot data.

In S60 the processor 110 supplies the print data generated in S50 to the printing mechanism 200. In S70 the controller 290 of the printing mechanism 200 prints images based on the print data received in S60. This completes the printing process of FIG. 5.

A-4. Types of Dots

Figure 6A:
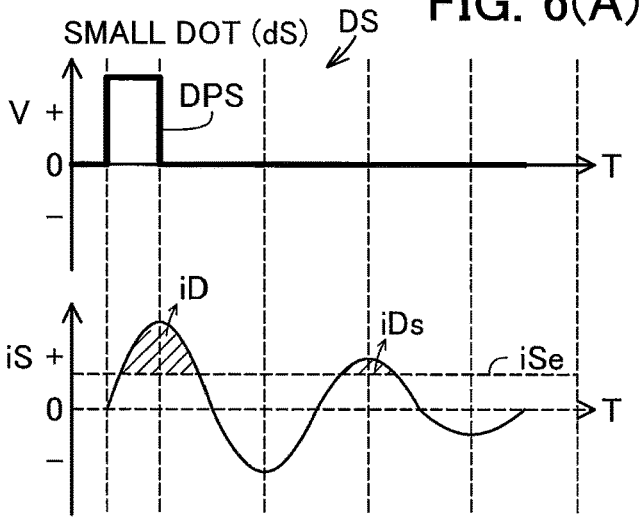
FIGS. 6(A)-6(C) are explanatory diagrams respectively illustrating a small dot, medium dot, and large dot.
Figure 6B:
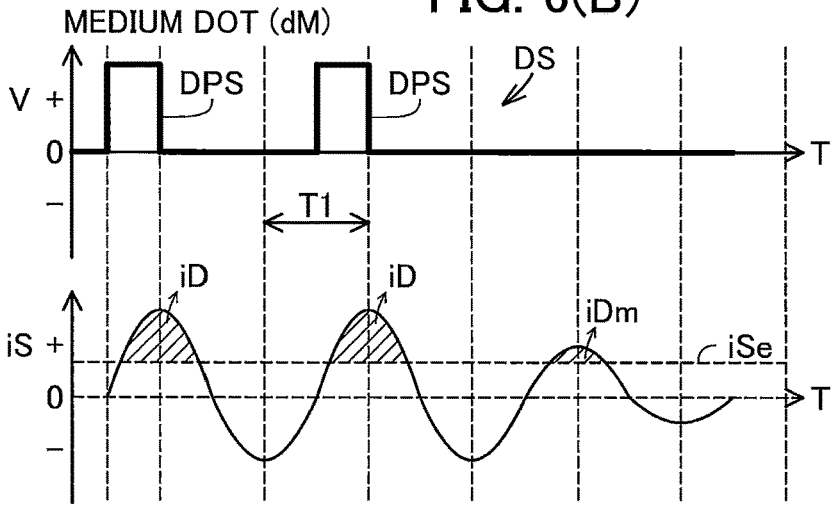
Figure 6C:
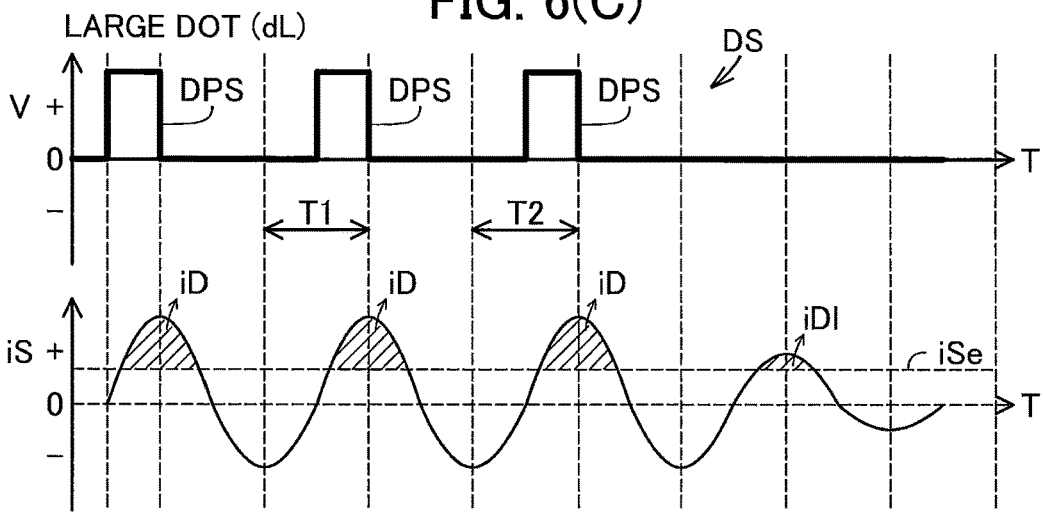

FIGS. 6(A)-6(C) and 7(A)-7(C) are explanatory diagrams showing various types of dots. FIGS. 6(A), 6(B), and 6(C) respectively illustrate a small dot, medium dot, and large dot, while FIGS. 7(A), 7(B), and 7(C) respectively illustrate three types of special dots X1, X2, and X3. Each of the drawings includes a graph showing the waveform of a voltage V for the drive signal DS (see FIG. 1), and a graph showing the position of the ink surface iS (see FIG. 2(B)) that varies in response to the drive signal DS. The horizontal axis in each graph denotes a time T. The "+" and "−" symbols in the graphs denote the sign of the voltage V. Specifically, the "+" symbol is a positive sign indicating that the piezoelectric element 32 (see FIG. 2(B)) is deflected in the "+" direction, while the "−" symbol is a negative sign indicating that the piezoelectric element 32 is deflected in the "−" direction. The "0" position indicates the position of the ink surface iS when at rest, i.e., when no drive signal DS is being supplied to the piezoelectric element 32. The "+" position of the ink surface iS indicates its position when moved in a direction from the "0" position toward the exterior of the nozzle part 37, while the "−" position denotes its position when moved from the "0" position toward the interior of the nozzle part 37.

As shown in FIG. 6(A), a small dot dS is formed by a single drive pulse signal DPS. This drive pulse signal DPS is a rectangular wave signal having positive sign (positive values). When this drive pulse signal DPS is supplied to the piezoelectric element 32, the ink surface iS moves in the "+" direction. When the movement of the ink surface iS exceeds drastically a prescribed threshold iSe, an ink droplet iD (see FIG. 2(B)) of a prescribed size is ejected from the nozzle NZ. Note that the threshold iSe denotes the position that the ink surface iS must reach in order for an ink droplet to be ejected. In other words, an ink droplet is ejected when the ink surface iS moves past the threshold iSe. After the drive pulse signal DPS has been supplied, the ink surface iS continues to oscillate between the "+" position and "−" position while the oscillations gradually decay. Even though oscillation of the ink surface iS decays after a drive pulse signal DPS is supplied, the position of the ink surface iS may still surpass the threshold iSe. In such a case, a small ink droplet iDs that is smaller than the ink droplet iD described above may be ejected. These ink droplets iD and iDs are deposited at approximately the same position on the sheet P and form a small dot.

As shown in FIG. 6(B), a medium dot dM is formed by two drive pulse signals DPS. The second drive pulse signal DPS is supplied to the piezoelectric element 32 within a time interval T1 following supply of the first drive pulse signal DPS. The time interval T1 is an interval during which the ink surface iS moves in the direction from the interior of the nozzle part 37 toward the exterior of the nozzle part 37 once the ink surface iS moves in the direction from the exterior of the nozzle part 37 toward the interior of the nozzle part 37 in response to the first drive pulse signal DPS. Thus, two ink droplets iD are ejected according to these two drive pulse signals DPS.

Here as well, the position of the oscillating ink surface iS may exceed the threshold iSe while oscillation of the ink surface iS decays following supply of the final drive pulse signal DPS. In such a case, a small ink droplet iDm that is smaller than the ink droplet iD described above may be ejected. These ink droplets iD and iDm are deposited at approximately the same position on the sheet P to form a medium dot.

When forming a medium dot dM, the second drive pulse signal DPS is supplied to the piezoelectric element 32 so as to apply pressure to the ink ik in the same direction in which the ink surface iS is oscillating. Accordingly, the oscillating amplitude of the ink surface iS following supply of the final (here, the second) drive pulse signal DPS can be larger than the oscillating amplitude of the ink surface iS following supply of a drive pulse signal DPS for forming a small dot dS. As a result, the small ink droplet iDm ejected when forming a medium dot dM may be larger than the small ink droplet iDs ejected when forming a small dot dS.

As shown in FIG. 6(C), a large dot dL is formed by three drive pulse signals DPS. The first and second drive pulse signals DPS are the same as the two drive pulse signals DPS shown in FIG. 6(B). The third drive pulse signal DPS is supplied to the piezoelectric element 32 within a time interval T2 following supply of the second drive pulse signal DPS. The dime interval T2 is an time interval during which the ink surface iS moves back in the direction from the interior of the nozzle part 37 toward the exterior of the nozzle part 37 after the ink surface iS moves in the direction from the exterior of the nozzle part 37 toward the interior of the nozzle part 37 in response to the second drive pulse signal. Three ink droplets iD are ejected by these three drive pulse signals DPS.

While oscillations of the ink surface iS decay following supply of the final drive pulse signal DPS, the position of the ink surface iS may still pass the threshold iSe. In such a case, a small ink droplet iDl that is smaller than the ink droplets iD may be ejected. These ink droplets iD and iDl are deposited at approximately the same position on the sheet P to form a large dot.

When forming a large dot dL, the second and third drive pulse signals DPS are supplied to the piezoelectric element 32 so that pressure is applied to the ink ik in the same direction in which the ink surface iS is oscillating. Therefore, the oscillating amplitude of the ink surface iS following supply of the final (here, the third) drive pulse signal DPS may be larger than the oscillating amplitude of the ink surface iS following supply of the final (here, the second) drive pulse signal DPS when forming a medium dot dM. As a result, the small ink droplet iDl ejected when forming a large dot dL may be larger than the small ink droplet iDm ejected when forming a medium dot dM.

The timings at which drive pulse signals DPS are supplied to the piezoelectric element 32 are preset so that the 1-3 relatively large ink droplets iD are suitably ejected as illustrated in FIGS. 6(A)-6(C). The head-driving circuit 230 supplies the 1-3 drive pulse signals DPS (and more generally, the drive signal DS) to the piezoelectric element 32 at the prescribed timings based on a signal received from the controller 290 identifying the type of dot.

Here, the drive pulse signals DPS included in the drive signal DS for each of the normal dots dS, dM, and dL are configured such that the relatively large ink droplets iD can impact the flat plate 214 at a position separated from the nozzle NZ of the nozzle part 37 (see FIG. 2(B); equivalent to the nozzle-forming surface 241 in this example) by a second distance D2 greater than a first distance D1. Here, the first distance D1 is between the nozzle NZ and sheet P (see FIG. 4(A)). In the embodiment, at least one of the small ink droplets iDs, iDm, and iDl is allowed to reach the flat plate 214. For example, the largest small ink droplet iDl may travel as far as the flat plate 214 separated from the nozzle NZ by the second distance D2. However, the smaller ink droplets iDs and iDm cannot impact the flat plate 214.

Consequently, when the small ink droplets iDs and iDm are ejected toward the outer area A11 (see FIG. 3) outside of the sheet P, the ink droplets iDs and iDm cannot impact the flat plate 214 and may become deposited on components in the printing mechanism 200 (the downstream rollers 218, for example), the back surface of the sheet P, or the like. Ink droplets iDs and iDm that become deposited at unintended positions in this way may stain sheets P or give rise to various other problems. In order to suppress the occurrence of these problems, the printer 600 of the embodiment uses special dots in addition to the usual large, medium, and small dots dL, dM, and dS.

Figure 7A:
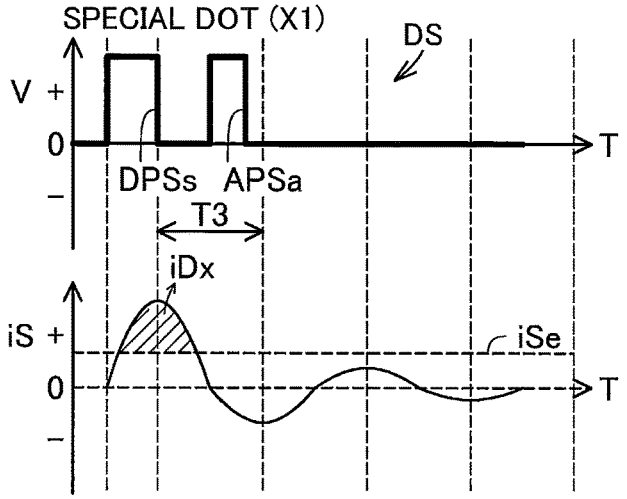
FIGS. 7(A)-7(C) are explanatory diagrams illustrating three types of special dots.

A first special dot X1 shown in FIG. 7(A) is formed by a single drive pulse signal DPSs, and a first additional pulse signal APSa following this drive pulse signal DPSs. The drive pulse signal DPSs is a rectangular wave signal having "+" sign (positive values), similar to the drive pulse signals DPS described above. An ink droplet iDx is ejected by the drive pulse signal DPSs. The drive pulse signal DPSs is configured such that the ink droplet iDx can impact the sheet P that is separated from the nozzle NZ of the nozzle part 37 (see FIG. 2(B)) by the first distance D1 and can further impact the flat plate 214 separated from the nozzle NZ by the second distance D2.

The first additional pulse signal APSa is a rectangular wave signal having "+" sign (positive values), similar to the drive pulse signal DPSs. Hence, as with the drive pulse signal DPSs, the first additional pulse signal APSa applies pressure to the ink ik in a direction from the interior to the exterior of the nozzle part 37. In the example shown in FIG. 7(A), the first additional pulse signal APSa is supplied to the piezoelectric element 32 within a time interval T3 following supply of the drive pulse signal DPSs. The time interval T3 is an interval during which the ink surface iS moves in the direction from the exterior of the nozzle part 37 toward the interior of the nozzle part 37 in response to the drive pulse signal DPSs. Accordingly, the first additional pulse signal APSa can reduce the oscillating amplitude of the ink surface iS, thereby suppressing oscillations of an amplitude larger than the threshold iSe. Thus, application of the first additional pulse signal APSa suppresses the ejection of small ink droplets iDs, and iDm following ejection of the ink droplet iDx. By using this first special dot X1 in the edge printing area A10 shown in FIG. 3, it is possible to suppress problems caused by the small ink droplets iDs, and iDm that cannot reach the flat plate 214. Note that the voltage V of the first additional pulse signal APSa is equivalent to the voltage V of the drive pulse signal DPSs, while the width of the first additional pulse signal APSa is smaller than that of the drive pulse signal DPSs.

Figure 7B:
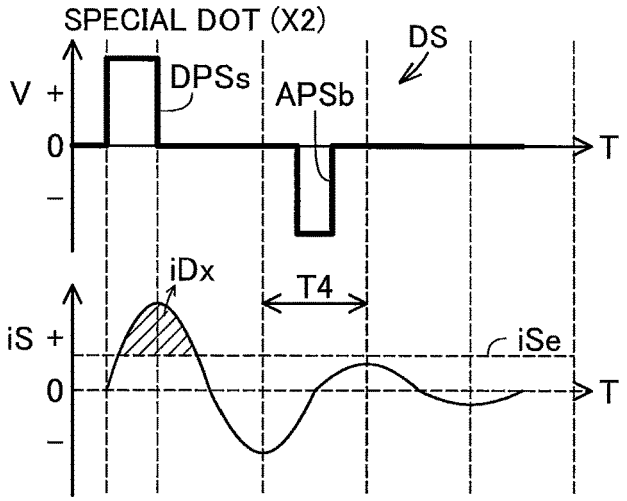

A second special dot X2 shown in FIG. 7(B) is formed by a single drive pulse signal DPSs identical to that in FIG. 7(A), and a second additional pulse signal APSb following the drive pulse signal DPSs. The second additional pulse signal APSb is a rectangular wave signal having "–" sign (negative values), that is the opposite sign of the drive pulse signal DPSs having positive values. Hence, the second additional pulse signal APSb applies pressure to the ink ik in the direction from the exterior to the interior of the nozzle part 37, opposite the direction applied by the drive pulse signal DPSs. In the example of FIG. 7(B), the second additional pulse signal APSb is supplied to the piezoelectric element 32 within a time interval T4 following supply of the drive pulse signal DPSs. The time interval T4 is an interval during which the ink surface iS moves back from the interior toward the exterior of the nozzle part 37 after the ink surface iS moves from the exterior toward the interior of the nozzle part 37 in response to the drive pulse signal DPSs. Accordingly, the second additional pulse signal APSb can reduce the oscillating amplitude of the ink surface iS, and in particular can suppress oscillations having a greater amplitude than the threshold iSe. Thus, application of the second additional pulse signal APSb suppresses the ejection of small ink droplets iDs and iDm following ejection of an ink droplet iDx. Note that the absolute value of the voltage V of the second additional pulse signal APSb is equivalent to the absolute value of the voltage V of the drive pulse signal DPSs, while the width of the second additional pulse signal APSb is smaller than that of the drive pulse signal DPSs.

Figure 7C:
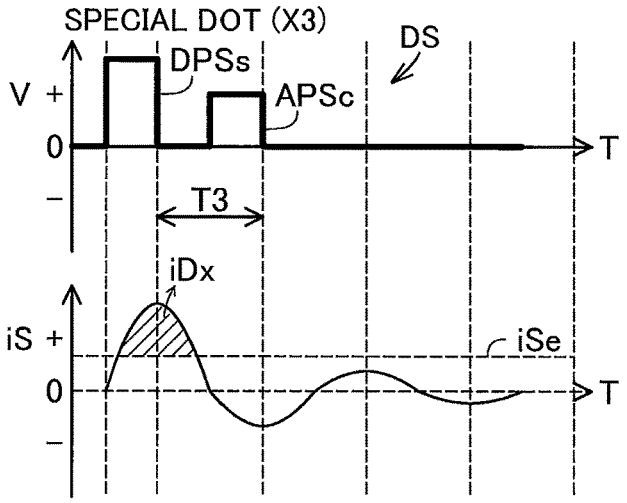

A third special dot X3 shown in FIG. 7(C) is formed by a single drive pulse signal DPSs, and a third additional pulse signal APSc following this drive pulse signal DPSs. The third additional pulse signal APSc has a "+" sign (positive values) within the same time interval T3 as the first additional pulse signal APSa of FIG. 7(A). Further, the voltage V and width of the third additional pulse signal APSc are adjusted from the voltage V and width of the first additional pulse signal APSa. That is, the wave form of the third additional pulse signal APSc is different from that of the first additional pulse signal. In this way, the voltage V of the additional pulse signal may be set to a different value from the voltage V of the drive pulse signal DPSs. This third additional pulse signal APSc can also suppress ejection of a small ink droplet iDs, similar to the first additional pulse signal APSa of FIG. 7(A). Note that the voltage V of the third additional pulse signal APSc is set smaller than the voltage V of the drive pulse signal DPSs, while the width of the third additional pulse signal APSc is set equivalent to the width of the drive pulse signal DPSs.

Any one of the special dots described above (specifically, the special dots X1, X2, and X3) may be used as the special dot in the embodiment. When the first special dot X1 of FIG. 7(A) is employed, the configuration of the head-driving circuit 230 can be simplified since the first additional pulse signal APSa and the drive pulse signal DPSs have the same voltage V and differ only in their duration. The following description will assume use of the first special dot X1. In any case, the head-driving circuit 230 supplies a drive signal DS including the drive pulse signal DPSs and one of the additional pulse signals APSa, APSb, and APSc to the piezoelectric element 32 at a predetermined timing based on the signal received from the controller 290 specifying the special dot.

A-5. Halftone Process

Figure 8:
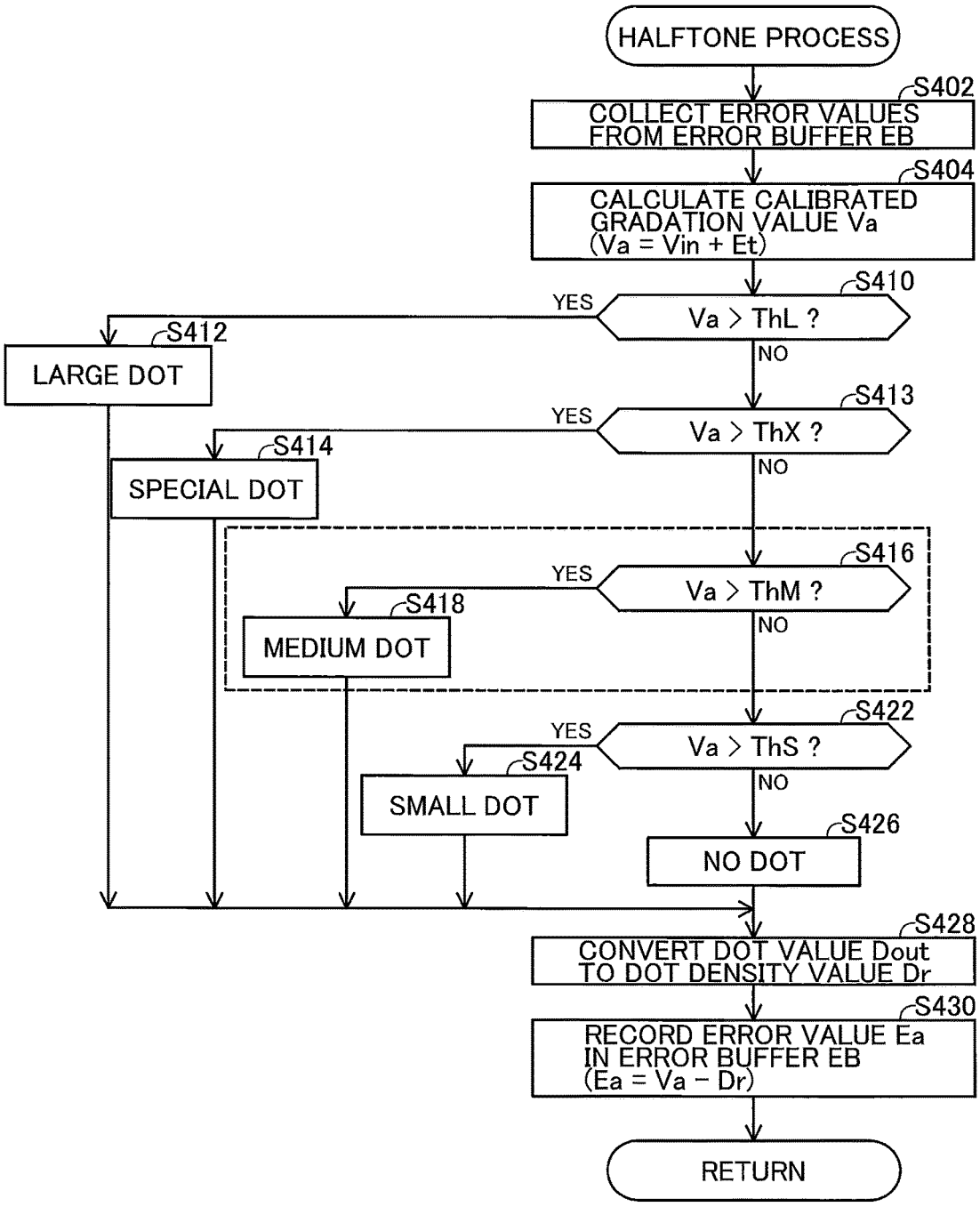
FIG. 8 is a flowchart illustrating steps in a halftone process shown in FIG. 5.
Figure 9:
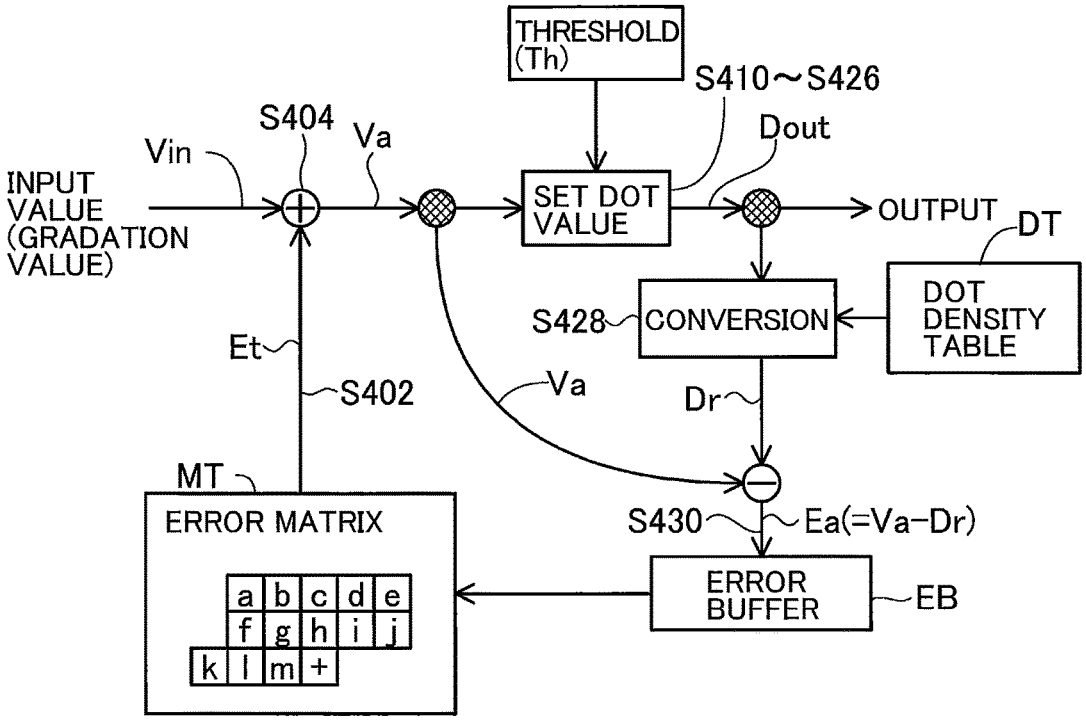
FIG. 9 is a schematic diagram illustrating an overview of an error diffusion process used in the halftone process.

FIG. 8 is a flowchart illustrating steps in the halftone process (S40 of FIG. 5). FIG. 9 shows an overview of the error diffusion process used in the halftone process. The processor 110 executes this error diffusion process on each of the CMYK component values making up the CMYK image data. The error diffusion process for a single component (the cyan (C) component, for example) is executed for each pixel. The CMYK image data represents an image having a plurality of pixels arranged in a matrix with a vertical dimension and a horizontal dimension, for example. By executing the error diffusion process sequentially for each pixel in a row, the processor 110 completes the process on a single row of pixels extending in the horizontal direction. After completing the process on one row of pixels, the processor 110 executes the error diffusion process on the next row of pixels adjacent to the just-processed row in the vertical direction. Thus, the processor 110 executes the error diffusion process on the plurality of pixel rows included in the CMYK image data by sequentially selecting each row of pixels in the vertical direction as the process target. Note that this order of processing pixels is merely an example, and the pixels may be processed in a different order.

In the halftone process of the embodiment, the processor 110 sets the dot value for each pixel being processed (hereinafter referred to as the "target pixel") to one of a plurality of dot formation states. In the embodiment, the dot value may be set to any value from "0" to "4". A dot value of "0" represents a dot-less value indicating that no dot is formed. A dot value of "1" represents a small dot value indicating that a small dot dS (see FIG. 6(A)) is formed. A dot value of "2" represents a medium dot value indicating that a medium dot dM (see FIG. 6(B)) is formed. A dot value of "3" represents a large dot value indicating that a large dot dL (see FIG. 6(C)) is formed. A dot value of "4" represents a special dot value indicating that a special dot (the first special dot X1 in FIG. 7(A), for example) is formed.

In S402 at the beginning of the error diffusion process in FIG. 8, the processor 110 collects error values stored in an error buffer EB and acquires a distributed error Et for the target pixel using an error matrix MT (see FIG. 9). As will be described later, the error buffer EB stores error values Ea produced for all pixels that have undergone the error diffusion process, i.e., processed pixels for which dot values have been set in the error diffusion process. The error matrix MT defines distribution ratios that have been assigned to each pixel in a prescribed relative position to the target pixel (a peripheral position to the target pixel). In the error matrix MT of FIG. 9, the "+" symbol represents the target pixel, and distribution ratios "a"-"m" have been assigned to peripheral pixels. The distribution ratios "a"-"m" total "1". Using the error matrix MT, the processor 110 calculates the distributed error Et of the target pixel to be the sum of products obtained by multiplying the error value Ea of each peripheral pixel by the corresponding distribution ratio.

In S404 the processor 110 calculates a calibrated gradation value Va by adding the distributed error Et and the gradation value of the target pixel (the input value $V_{in}$).

In S410 the processor 110 determines whether the calibrated gradation value Va is greater than a large dot threshold ThL. If Va>ThL (S410: YES), in S412 the processor 110 sets the dot value $D_{out}$ for the target pixel to the large dot value. Subsequently, the processor 110 advances to S428.

If Va≤ThL (S410: NO), in S413 the processor 110 determines whether the calibrated gradation value Va is greater than a special dot threshold ThX. If Va>ThX (S413: YES), in S414 the processor 110 sets the dot value $D_{out}$ for the target pixel to the special dot value. Subsequently, the processor 110 advances to S428.

If Va≤ThX (S413: NO), in S416 the processor 110 determines whether the calibrated gradation value Va is greater than a medium dot threshold ThM. If Va>ThM (S416: YES), in S418 the processor 110 sets the dot value $D_{out}$ for the target pixel to the medium dot value. Subsequently, the processor 110 advances to S428.

If Va≤ThM (S416: NO), in S422 the processor 110 determines whether the calibrated gradation value Va is greater than a small dot threshold ThS. If Va>ThS (S422: YES), in S424 the processor 110 sets the dot value $D_{out}$ for the target pixel to the small dot value. Subsequently, the processor 110 advances to S428.

If Va≤ThS (S422: NO), in S426 the processor 110 sets the dot value $D_{out}$ for the target pixel to the "no dot" value. Subsequently, the processor 110 advances to S428.

Generally, the threshold values ThS, ThM, and ThL for normal dots are set such that ThS≤ThM≤ThL. In the embodiment, the special dot threshold ThX is further set to a value such that ThM≤ThX≤ThL. These dot thresholds ThS, ThM, ThL, and ThX further varies according to the position of the target pixel in the printing area PA described in FIG. 3. This will be described later in greater detail.

In S428 the processor 110 converts the dot value $D_{out}$ (see FIG. 9) set in the above steps to the corresponding dot density value Dr. Corresponding dot density values Dr are set for all possible dot values $D_{out}$. The dot density value Dr indicates the density rendered by the dot formation state and is expressed as a gradation value corresponding to the respective CMYK value. The dot density value Dr is larger for larger sizes of dots. Dot density values Dr are recorded in a relative value table (or dot density table) DT and integrated in the computer program PG, for example. In the embodiment, the size of a special dot is set between the sizes of the medium dot dM and large dot dL.

In S430 the processor 110 calculates the error value Ea according to the following equation.

Error value Ea=calibrated gradation value Va−dot density value Dr

The error value Ea can be considered error produced between the dot density value Dr corresponding to the dot value for the target pixel and the gradation value of the target pixel (the calibrated gradation value Va). The processor 110 records the error value Ea in the error buffer EB. The error buffer EB stores error values Ea calculated in S430 for each processed pixel for which a dot value was set in the error diffusion process. The distributed error Et acquired in S402 described above is the error distributed to the target pixel using the error matrix MT from among the error values Ea recorded in the error buffer EB, i.e., the error value Ea produced from the processed pixels.

Thus, the error diffusion process described above generates dot data for each color of ink, the dot data including a dot value for each pixel. Further, the calibrated gradation value Va for each target pixel is compared to dot thresholds in the order given above, i.e., the large dot threshold ThL, the special dot threshold ThX, the medium dot threshold ThM, and the small dot threshold ThS.

Figure 10:
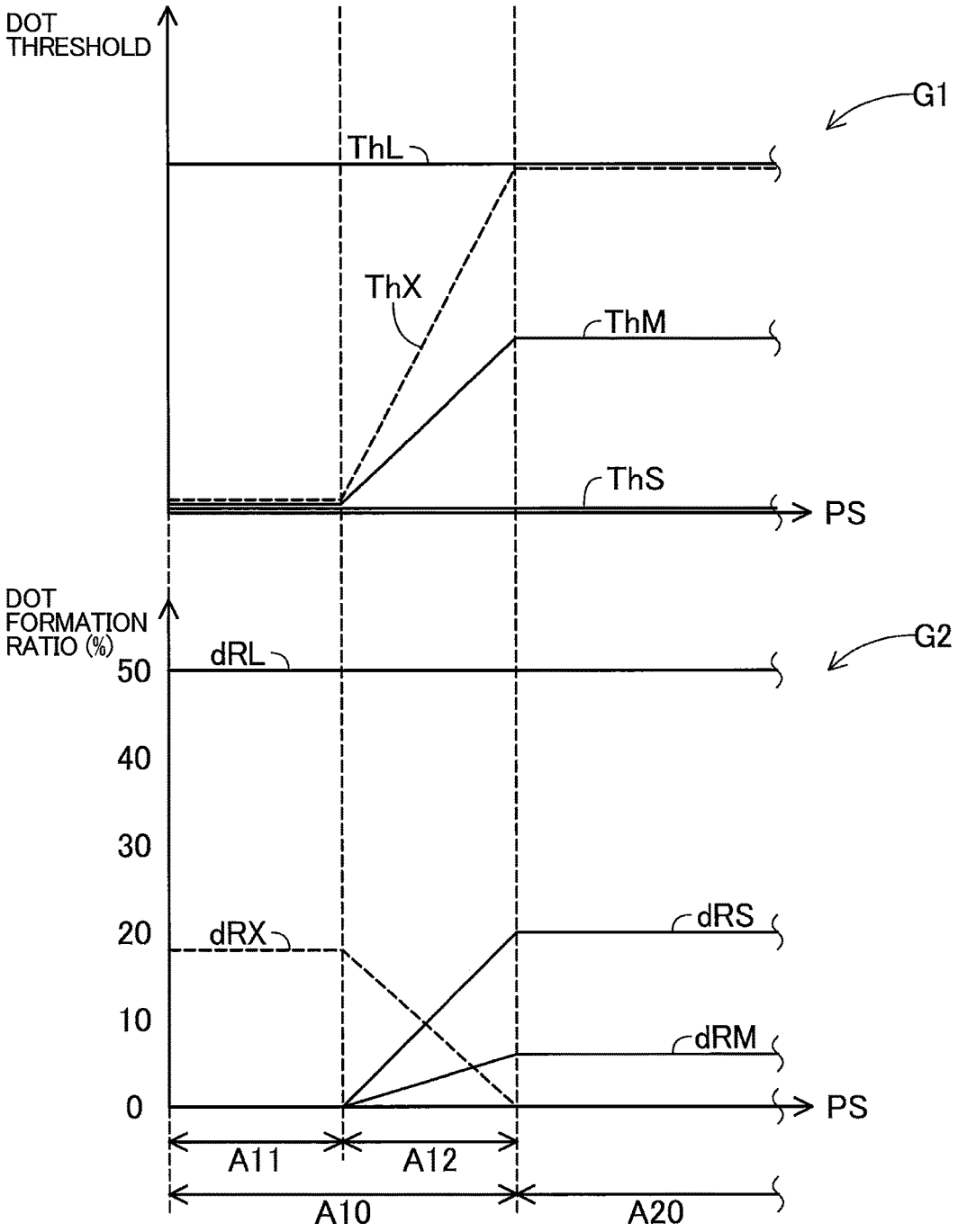
FIG. 10 is a schematic diagram illustrating a general relationships among the dot thresholds and positions in the printing area according to the first embodiment.

A-6. Values of Dot Thresholds for Different Positions in the Printing Area PA FIG. 10 shows the general relationships among the dot thresholds ThS, ThM, ThL, and ThX and positions in the printing area PA (see FIG. 3). A first graph G1 in the top of FIG. 10 shows the relationships among positions in the printing area PA and the dot thresholds, where the horizontal axis denotes a position PS within a range extending from the outer area A11 through the first area A12 to the interior printing area A20 and the vertical axis denotes the magnitude of the dot thresholds. Note that the horizontal axis indicates the position in the printing area PA relative to the X direction. However, the configuration (or shape) of the first graph G1 would be identical if the horizontal axis indicated positions relative to the Y direction.

A second graph G2 provided in the bottom of FIG. 10 shows the relationships among positions PS in the printing area PA and dot formation ratios, where the horizontal axis is identical to the horizontal axis in the first graph G1 and the vertical axis denotes the dot formation ratio. Here, a large dot formation ratio dRL, a medium dot formation ratio dRM, a small dot formation ratio dRS, and a special dot formation ratio dRX denote the formation ratios of large dots, medium dots, small dots, and special dots, respectively. The dot formation ratio indicates the percentage of pixels at which dots are formed when the error diffusion process described above is executed on a uniform image configured of pixels having a specific gradation value. A dot formation ratio of 100% for a certain dot signifies that the dot is formed at all pixel positions.

As indicated in the first graph G1, all of the dot thresholds ThS, ThM, ThL, and ThX are constant within the interior printing area A20 regardless of the position PS. Here, numeral 0=ThS<ThM<ThX=ThL. In particular, the special dot threshold ThX is equivalent to the large dot threshold ThL within the interior printing area A20. Further, in the halftone process described in FIG. 8, the calibrated gradation value Va is compared to dot thresholds in the order of ThL, ThX, ThM, and ThS. Thus, even when the calibrated gradation value Va is greater than the special dot threshold ThX, the processor 110 executes the process of S412 rather than the process of S414 because the calibrated gradation value Va is also greater than the large dot threshold ThL to which the calibrated gradation value Va is compared prior to comparison to the special dot threshold ThX. Hence, the processor 110 sets the dot value for the target pixel to the large dot value in this case. Accordingly, no special dots are formed in the interior printing area A20. As illustrated in the second graph G2, the special dot formation ratio dRX is at 0% within the interior printing area A20, while the dot formation ratios dRL, dRM, and dRS are all greater than 0% and have constant values independent of the position PS in the interior printing area A20.

As shown in the first graph G1, each of the dot thresholds ThS, ThM, ThL, and ThX is also constant and independent of the position PS within the outer area A11. Here, 0=ThS=ThM=ThX<ThL. In particular, the special dot threshold ThX is smaller than the large dot threshold ThL and equivalent to the medium dot threshold ThM and the small dot threshold ThS. Thus, if the calibrated gradation value Va is less than or equal to the large dot threshold ThL and greater than both the medium dot threshold ThM and the small dot threshold ThS, the calibrated gradation value Va also exceeds the special dot threshold ThX to which the calibrated gradation value Va is compared prior to comparison to the medium dot threshold ThM and comparison to the small dot threshold ThS. Accordingly, the processor 110 executes the process of S414 rather than the process in S418 or S424, and sets the dot value for the target pixel to the special dot value. As a result, small dots and medium dots are not formed in the outer area A11. As illustrated in the second graph G2, the dot formation ratios dRM and dRS are at 0% within the outer area A11, and the dot formation ratios dRL and dRX are at values greater than 0% and constant values independent of the position PS within the outer area A11.

As shown in the first graph G1, each of the dot thresholds ThS, ThM, ThL, and ThX within the first area A12 is set to values that fall on a straight line extending from its value in the outer area A11 to its value in the interior printing area A20. As illustrated in the second graph G2, the special dot formation ratio dRX gradually increases from 0 within the first area A12 from the interior printing area A20 side toward the outer area A11 side, while the small dot formation ratio dRS and medium dot formation ratio dRM gradually decreases toward 0 in the same direction.

The threshold data TD (see FIG. 1) represents these correlations between the positions PS in the printing area PA and the dot thresholds ThS, ThM, ThL, and ThX. The threshold data TD may be configured as a lookup table, for example. When executing the halftone process of FIG. 8, the processor 110 references the threshold data TD to identify dot thresholds ThS, ThM, ThL, and ThX corresponding to the position PS of the target pixel.

As described above with reference to FIGS. 7(A)-7(C), the special dots X1, X2, and X3 in the embodiment are formed through following two processes. One process includes supplying a drive pulse signal DPSs to the piezoelectric element 32 (see FIG. 2(B)) for ejecting an ink droplet iDx. Another process includes supplying one of the additional pulse signals APSa, APSb, and APSc to the piezoelectric element 32 in order to apply pressure to the ink ik acting in the direction opposite the oscillating direction of the ink surface iS in the nozzle part 37 following ejection of the ink droplet iDx. Further, as described with reference to FIGS. 6(A)-6(C), the normal dots dS, dM, and dL are formed through a process that includes supplying drive pulse signal DPSs to the piezoelectric element 32 for ejecting ink droplet iD from the nozzle NZ of the nozzle part 37 but not supplying an additional pulse signal to the piezoelectric element 32.

As described with reference to FIG. 10, the processor 110 generates print data under the condition that special dots (the first special dots X1 in this example) for suppressing the small ink droplets iDs and iDm are formed in the edge printing area A10. By reducing the ratio of other dots (small dots and medium dots, for example) in the edge printing area A10, the processor 110 can suppress the ejection of small ink droplets iDs and iDm, thereby reducing problems caused by such small ink droplets iDs and iDm.

The processor 110 also generates print data under the condition that the normal dots dS, dM, and dL and not special dots are formed in the interior printing area A20. Unlike when forming the special dots X1, X2, and X3, ejection of small ink droplets iDs, iDm, and iDl are allowed when forming the normal dots dS, dM, and dL. Therefore, there is a greater freedom of design for the drive signal DS used in forming the normal dots dS, dM, and dL than the drive signal DS used for forming the special dots X1, X2, and X3. The normal dots dS, dM, and dL can mitigate the adverse effects on image quality better than the special dots X1, X2, and X3. For example, heightened graininess in the interior printing area A20 can be suppressed by ejecting the small ink droplets iDs, iDm, and iDl. Further, since the small dot dS can be produced at a smaller dot size than that of the special dots X1, X2, and X3, use of the small dots dS can also suppress graininess in the interior printing area A20.

Further, as described with reference to FIG. 10, the processor 110 generates print data under the condition that the normal dots dS, and dM are not formed in the outer area A11 constituting the outer portion of the edge printing area A10. Accordingly, since the small ink droplets iDs and iDm are not ejected in the outer area A11, the processor 110 can suppress problems caused by such small ink droplets iDs and iDm.

As described with reference to FIGS. 7(A)-7(C), the drive signal DS for forming one of the special dots X1, X2, and X3 is configured such that the ink droplet iDx for forming the special dots X1, X2, and X3 can reach both the sheet P and the flat plate 214 from the nozzle NZ of the nozzle part 37 (see FIG. 2(B)). Hence, by using the special dots X1, X2, and X3, the processor 110 can avoid such problems caused when ink droplets do not reach the flat plate 214. Further, the ink droplets iD, iDs, iDm, and iDl for forming the normal dots dS, dM, and dL are all capable of landing on the sheet P, but the small ink droplets iDs and iDm cannot reach the flat plate 214. In general, the ink droplets iDs and iDm are smaller than the ink droplets iD and iDl that are capable of reaching the flat plate 214. Accordingly, the use of normal dots dS, dM, and dL can reduce graininess, since small ink droplets iDs and iDm are ejected.

As illustrated in FIGS. 6(A)-6(C) and 7(A)-7(C), rectangular-shaped waveforms are used for each of the drive pulse signals DPS and DPSs and for each of the additional pulse signals APSa, APSb, and APSc. This avoids an increase in the complexity of the structure of the head-driving circuit 230. For example, the head-driving circuit 230 may employ a structure that includes a semiconductor switch that switches the voltage supply to the piezoelectric element 32 of the print head 240 on and off, and a logic circuit that controls the semiconductor switch.

As shown in FIG. 7(B), the second additional pulse signal APSb used for forming the second special dot X2 has an opposite sign (or negative sign) to that of the drive pulse signal DPSs having a positive sign. The second additional pulse signal APSb is supplied to the piezoelectric element 32 of the print head 240 beginning within the time interval T4 during which the ink surface iS of the ink ik (see FIG. 2(B)) is in the portion of its oscillating period moving in the direction from the interior toward the exterior of the nozzle part 37. Supply of the second additional pulse signal APSb is also stopped within the time interval T4. With this configuration, the second additional pulse signal APSb can reduce the oscillating amplitude of the ink surface iS, thereby suppressing ejection of small ink droplets caused by such oscillation.

Further, as illustrated in FIGS. 7(A) and 7(C), the additional pulse signals APSa and APSc for respectively forming the special dots X1 and X3 have the same sign (or plus sign) as that of the drive pulse signal DPSs having a positive sign. The additional pulse signals APSa and APSc are supplied to the piezoelectric element 32 of the print head 240 beginning in the time interval T3 during which the ink surface iS of the ink ik is in the portion of its oscillating period moving in the direction from the exterior toward the interior of the nozzle part 37. Supply of the additional pulse signals APSa and APSc is also stopped within the time interval T3. With this configuration, the additional pulse signals APSa and APSc can reduce the oscillating amplitude of the ink surface iS, thereby suppressing ejection of small ink droplets caused by such oscillation.

As described with reference to FIGS. 8 and 9, the processor 110 sets the dot formation state of each pixel through an error diffusion process. The processor 110 compares the calibrated gradation value Va to dot thresholds in the order of the large dot threshold ThL, the special dot threshold ThX, the medium dot threshold ThM, and the small dot threshold ThS. Further, as illustrated in FIG. 10, the special dot threshold ThX is equivalent to the small dot threshold ThS within the outer area A11 constituting the outer portion of the edge printing area A10. In this way, special dots are formed in the outer area 11 and no small dots dS are formed in the outer area A11, suppressing problems caused by ink droplets (including the small ink droplets iDs) used for forming the small dots dS. Further, small dots dS are formed in the interior printing area A20 while special dots are not, thereby suppressing graininess within the interior printing area A20.

As described with reference to FIG. 10, the medium dot threshold ThM is equivalent to the special dot threshold ThX in the outer area A11 constituting the outer portion of the edge printing area A10. Hence, special dots dX are formed within the outer area A11 while medium dots dM are not, thereby suppressing problems caused by ink droplets (including small ink droplets iDm) used for forming the medium dots dM.

B. Second Embodiment

Figure 11:
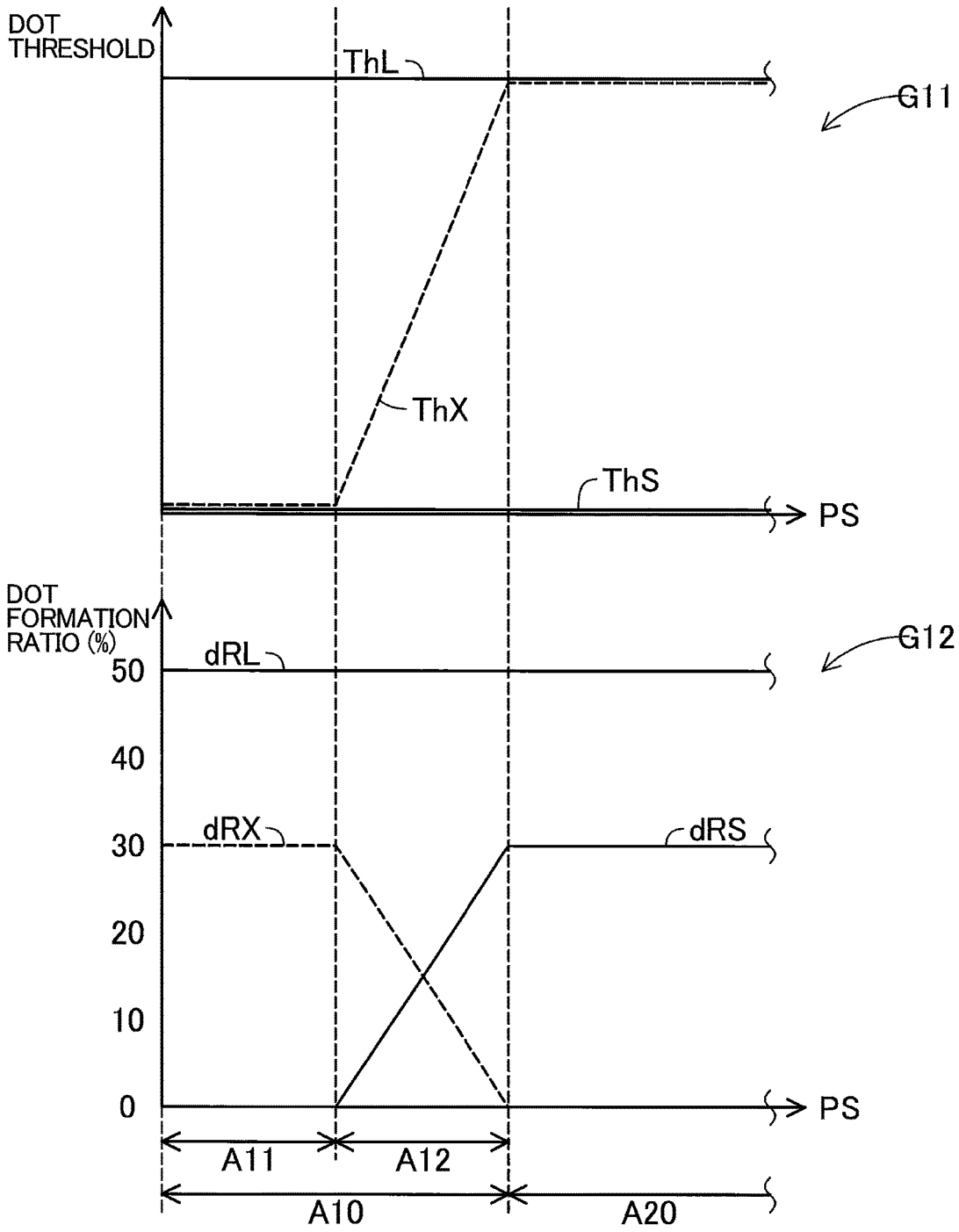
FIG. 11 is a schematic diagram illustrating a general relationships among dot thresholds and positions in a printing area according to a second embodiment.

FIG. 11 illustrates the general relationships among the dot thresholds ThS, ThL, and ThX and the position within the printing area PA (see FIG. 3) according to a second embodiment. In the second embodiment, the medium dot dM is not formed, and thus the process shown in the flowchart of FIG. 8 omit steps S416 and S418 related to the medium dot dM. Thus, when a "NO" determination is made in S413, the process advances directly to S422. Further, in the second embodiment, the calibrated gradation value Va is compared to dot thresholds in the order of the large dot threshold ThL, the special dot threshold ThX, and the small dot threshold ThS. The size of the special dots in the second embodiment will be a size between those of the small dot dS and the large dot dL.

The first graph G11 in the top of FIG. 11 shows the relationships among the positions PS in the printing area PA (horizontal axis) and the dot thresholds (vertical axis), similar to the first graph G1 in FIG. 10. A second graph G12 in the bottom of FIG. 11 shows the relationships among the positions PS in the printing area PA (horizontal axis) and the dot formation ratios (vertical axis), similar to the second graph G2 in FIG. 10. The horizontal axis of the second graph G12 is the same as that in the first graph G11. The large dot formation ratio dRL, the small dot formation ratio dRS, and the special dot formation ratio dRX specify the formation ratios of large dots, small dots, and special dots, respectively.

As shown in the first graph G11, each of the dot thresholds ThS, ThX, and ThL is constant in the interior printing area A20 and independent of the position PS in the interior printing area A20. Here, 0=ThS<ThX=ThL. As in the first embodiment described in FIG. 10, special dots are not formed in the interior printing area A20 since the special dot threshold ThX is equivalent to the large dot threshold ThL. As shown in the second graph G12, the special dot formation ratio dRX is 0% in the interior printing area A20, while the dot formation ratios dRS and dRL are values that are greater than 0 and are constant values independent of the position PS in the interior printing area A20. Thus, small dots dS are formed in the interior printing area A20 while special dots are not, thereby suppressing graininess in the interior printing area A20.

As shown in the first graph G11, each of the dot thresholds ThS, ThX, and ThL in the outer area A11 is constant, regardless of the position PS. Here, 0=ThS=ThX<ThL. As in the first embodiment of FIG. 10, special dots rather than small dots dS are formed in the outer area A11 constituting the outside portion of the edge printing area A10 since the special dot threshold ThX is equivalent to the small dot threshold ThS, thereby suppressing the problems caused by ink droplets (including the small ink droplets iDs) used to form small dots dS.

As shown in the first graph G11, each of the dot thresholds ThS, ThL, and ThX is set to values that fall on a straight line in the first area A12 extending from its value in the outer area A11 to its value in the interior printing area A20. As illustrated in the second graph G12, the special dot formation ratio dRX increases gradually from 0 in a direction from the interior printing area A20 side toward the outer area A11 side, while the small dot formation ratio dRS decreases gradually toward 0 in the same direction.

C. Variations of the Embodiments (1) In the first and second embodiments, description explains correlations between the positions in the printing area PA and the types of dots allowed to be formed thereat with reference to FIGS. 10 and 11. However, various correlations may be used in place of the correlations described with reference to FIGS. 10 and 11. For example, the correlations may allow the formation of special dots (the first special dots X1, for example) while not allowing formation of normal dots dS, and dM in the first area A12. In this case, the dot thresholds ThS, ThM, and ThL for the first area A12 may be set to the same values as the corresponding dot thresholds used in the outer area A11.

Alternatively, correlations for the first area A12 may allow formation of the normal dots dS, dM, and dL while not allowing formation of special dots. In this case, the dot thresholds ThS, ThM, ThL, and ThX used in the first area A12 may be set to the same values as the corresponding dot thresholds used in the interior printing area A20. Note that the first area A12 may be eliminated in this case, with the entire region of the sheet P corresponding to the interior printing area A20 and the outer area A11 corresponding to the edge printing area A10.

An edge printing area may defined as an area that includes the area outside the sheet P, and in which special dots are formed. The edge printing area may include an inner area and an outer area. Here, the inner area is an area whose shortest distance from the edge of the printing area PA is at least a prescribed value. The outer area is an area whose shortest distance from the edge of the sheet P is less than the prescribed value. Correlations used in the edge printing area may allow the formation of normal dots in the inner area, while not allowing formation of normal dots in an outer area. Here, the edge printing area may be an area entirely outside the sheet P or may include both part of the area of the sheet P and an area outside the sheet P. Further, the outer area may be an area entirely outside the sheet P or may include both part of the area of the sheet P and an area outside the sheet P. Further, the inner area may by an area entirely outside the sheet P or may include both part of the area of the sheet P and at least part of an area outside the sheet P, or the entire inner area may constitute part of the area of the sheet P. In any of these cases, special dots are formed in the edge printing area.

Further, correlations in the edge printing area may not allow formation of normal dots, or alternatively may allow formation of normal dots in a partial region on the interior side of the edge printing area. Alternatively, formation of normal dots may be allowed across the entire edge printing area. For example, the special dot threshold ThX may be set slightly larger than the dot thresholds ThS and ThM for the outer area A11 in FIGS. 10 and 11. In this case, small dots dS or medium dots dM are formed in the outer area A11 in addition to the first area A12, thereby suppressing increased graininess in edge regions of the sheet P (particularly edges that protrude into the outer area A11), even when the position of the sheet P shifts during conveyance. Further, the formation of special dots in the edge printing area A10 can suppress problems caused by small ink droplets.

(2) The relatively large ink droplets iD for forming the normal dots dS, dM, and dL (see FIG. 6) may be designed to be able to reach the sheet P separated by the first distance D1 from the nozzle NZ of the nozzle part 37 (see FIG. 2(B)) but to be unable to reach a position (the flat plate 214, for example) separated from the nozzle NZ by the second distance D2 greater than the first distance D1. This variation can also suppress problems caused by small ink droplets, provided that the normal dots dS, dM, and dL are not formed in the outer area A11 (see FIG. 3).

Alternatively, all ink droplets used for forming at least one type of normal dot may be configured to be capable of reaching the sheet P but no ink droplets used for forming the at least one type of normal dot capable of reaching a position separated by the second distance D2 from the nozzle NZ. For example, the ink droplets iD for forming the small dots dS may be smaller than the ink droplets iD for forming the medium dots dM and large dots dL, and particularly may be small enough to be unable to reach the flat plate 214.

In either case, the drive signal DS for forming normal dots is configured such that all ink droplets are able to reach the sheet P.

(3) In the example of FIG. 7(B), the timing at which the second additional pulse signal APSb is supplied to the piezoelectric element 32 may be any timing within the interval in which the ink surface iS is moving from the interior toward the exterior of the nozzle part 37. Here, the second additional pulse signal APSb is preferably supplied to the piezoelectric element 32 within the first interval immediately following supply of the drive pulse signal DPSs during which the ink surface iS is moving in the direction from the interior toward the exterior of the nozzle part 37, as illustrated by the time interval T4 of FIG. 7(B). This configuration can suppress the ink surface iS from moving beyond the threshold iSe following supply of the drive pulse signal DPSs. Note that the ink surface iS may be moving in the direction from the exterior toward the interior of the nozzle part 37 during a portion of the interval between the start and end of the second additional pulse signal APSb. In general, it is preferable that supply of the second additional pulse signal APSb begins during the interval in which the ink surface iS is moving from the interior toward the exterior of the nozzle part 37 in order to reduce the oscillating amplitude of the ink surface iS. It is particularly preferable that supply of the second additional pulse signal APSb also ends during the same interval.

(4) In the examples of FIGS. 7(A) and 7(C), the timing at which the additional pulse signals APSa and APSc are supplied to the piezoelectric element 32 may be any timing within the interval in which the ink surface iS is moving in the direction from the exterior toward the interior of the nozzle part 37. Here, the additional pulse signals APSa and APSc are preferably supplied to the piezoelectric element 32 within the first interval immediately following supply of the drive pulse signal DPSs during which the ink surface iS is moving in the direction from the exterior toward the interior of the nozzle part 37, as illustrated by the time interval T3 of FIGS. 7(A) and 7(C). This configuration can suppress the ink surface iS from moving beyond the threshold iSe following supply of the drive pulse signal DPSs. Note that the ink surface iS may be moving in the direction from the interior toward the exterior of the nozzle part 37 during a portion of the interval between the start and end of the additional pulse signals APSa and APSc. In general, it is preferable that supply of the additional pulse signals APSa and APSc begins during the interval in which the ink surface iS is moving from the exterior toward the interior of the nozzle part 37 in order to reduce the oscillating amplitude of the ink surface iS. It is particularly preferable that supply of the additional pulse signals APSa and APSc also ends during the same interval.

(5) A special dot may also be formed by two or more ink droplets. In any case, the drive signal DS for forming the special dot is preferably configured such that all N ink droplets (where N is an integer of 1 or greater) for forming the special dot can reach a position (the flat plate 214, for example) separated from the nozzle NZ by the second distance D2 greater than the first distance D1.

(6) One or more of the pulse signals among the drive pulse signal DPS and DPSs (see FIGS. 6(A)-6(C) and 7(A)-7(C)) and the additional pulse signals APSa, APSb, and APSc may have a waveform that is not rectangular in shape. For example, the waveform of the pulse signal may be curved in shape, as in a sine wave.

(7) Another method may be used to implement the halftone process in place of the method described with reference to FIGS. 8 and 9. For example, each of the CMYK values may be broken down (or converted) into dot gradation values for the various types of dots, with the dot gradation values being used as the input value $V_{in}$ in the error diffusion process. The halftone process for cyan (C) in this case is performed as follows. First, a gradation value for cyan is converted to one of a small dot gradation value Cs, a medium dot gradation value Cm, a large dot gradation value Cl, and a special dot gradation value Cx. Correlations between the gradation values of cyan and each of the dot gradation values Cs, Cm, Cl, and Cx are determined in advance. For example, when the gradation value for cyan is small, the small dot gradation value Cs is set to a value greater than 0, and the medium dot gradation value Cm and large dot gradation value Cl are set to 0. When the gradation value for cyan increases moderately, the medium dot gradation value Cm is increased and the small dot gradation value Cs is decreased. As the gradation value for cyan increases further, the small dot gradation value Cs is set to 0, the medium dot gradation value Cm is decreased, and the large dot gradation value Cl is increased. In order to implement the dot formation ratios described in the embodiment (the dot formation ratios of FIGS. 10 and 11, for example), all of the small dot gradation values Cs and the medium dot gradation values Cm are converted to special dot gradation values Cx in the outer area A11 (see FIG. 3). The special dot gradation value Cx is maintained at 0 within the interior printing area A20. Some of the small dot gradation values Cs and the medium dot gradation values Cm are replaced with special dot gradation values Cx in the first area A12. The ratio of this replacement increases for position PS closer to the outer area A11. The error diffusion process is then executed on each of the dot gradation values Cs, Cm, Cl, and Cx set as described above. The results of the error diffusion process on the small dot gradation values Cs depict the pattern in which the small dots dS are arranged, and the error diffusion processes on the other dot gradation values similarly depict the patterns in which the other dots are arranged. The priority may be set among the dot formation state of the dots dS, dM, dX, and dL. In this case, when the result of the error diffusion process indicates that a plurality of dots among the dots dS, dM, dX, and dL is formed, the dot of the top priority is actually formed. For example, in a case when the priority of the dot dM is higher than the priority of the dot dS and when both the dots dS and dM are determined to be formed for one pixel as a result of the error diffusion process, only the dot dM may be formed.

Correlations between the dot gradation values Cs, Cm, Cl, and Cx and cyan gradation values are defined in a lookup table, for example. Here, a plurality of lookup tables that differ according to the position PS in the printing area PA is used. Note that a process employing dither matrices may also be used on dot gradation values in the halftone process instead of the error diffusion process. The halftone process for other colors is performed similarly to the color of cyan.

(8) Other relationships among the dot formation ratios dRL, dRM, and dRS and the positions PS in the printing area PA may be used instead of those shown in FIGS. 10 and 11. For example, when printing a uniform image represented by fixed gradation values, the dot formation ratios dRL, dRM, and dRS may also vary according to the position PS within the interior printing area A20.

(9) The types of ink employed in printing may be different from the CMYK colors. For example, the types of ink employed in printing may be the three colors CMY, the single color K, or five colors including CMYK as well as LC, or light cyan, which is lighter than C.

(10) The conveying mechanism 210 is not limited to the configuration described in FIG. 4, provided that the conveying mechanism 210 can execute borderless printing. For example, the support members 212 may be provided on the +Y side of the flat plate 214. Further, an ink-receiving part for receiving ink droplets that do not land on the sheet P is preferably provided at a position separated from the nozzle part 37 (and specifically, the nozzle NZ) by the second distance D2 in the direction from the nozzle NZ toward the sheet P (the direction perpendicular to the plane of the sheet P). Here, the second distance D2 is greater than the first distance D1 between the nozzle NZ and sheet P (see FIG. 4(A)). The ink-receiving part may be any type of member and need not be a plate-shaped member like the flat plate 214 in FIG. 4. For example, the ink-receiving part may be an absorbent member capable of absorbing ink, such as a sponge. Further, the structure of the ejection section 30 is not limited to that shown in FIG. 2(B). For example, a pressure applying part that applies pressure to the ink ik may be configured of any apparatus capable of applying pressure to the ink ik (such as a heater for heating the ink ik) and need not be the piezoelectric element 32. Further, the printing mechanism 200 may be configured of a line printer or other printing apparatus that does not perform main scans.

(11) The controller 100 and the printing mechanism 200 shown in FIG. 1 may be apparatuses that are separate from each other. For example, the printing mechanism 200 may be a multifunction peripheral having scanning and other functions in addition to a printing function. The controller 100 may be a standalone image processing apparatus independent of the printing mechanism 200, such as a personal computer or a smartphone. Further, a plurality of apparatuses that can communicate over a network (computers, for example) may each implement some of the functions for executing the image processes of the image processing apparatus so that the apparatuses as a whole can provide the functions required to execute the image processes. (Here, the system including the apparatuses corresponds to the image processing apparatus.)

Part of the configuration of the disclosure implemented in hardware in each embodiment described above may be replaced by software and, conversely, part of the configuration of the disclosure implemented in software may be replaced by hardware. For example, the function of the halftone process S40 shown in FIG. 5 may be performed by a dedicated hardware.

When all or part of the functions in the present disclosure are implemented by computer programs, the programs can be stored on a computer-readable storage medium (a non-temporary storage medium, for example). The programs may be used from the same storage medium on which they are provided (an example of a computer-readable storage medium), or may be first loaded onto a different storage medium (an example of a computer-readable storage medium). The "computer-readable storage medium" may be a portable medium, such as a memory card or CD-ROM; an internal storage device built into the computer, such as any of various ROM; or an external storage device, such as a hard disk drive connected to the computer.

While the disclosure has been described in detail with reference to the above embodiments, it would be apparent to those skilled in the art that various changes and modifications may be made therein.

What is claimed is:

1. An image processing apparatus comprising a controller configured to perform:

acquiring target image data;

generating print data using the target image data, the print data representing dot formation states for respective pixels in a printing area, the printing area including an edge printing area and an interior printing area inside the edge printing area, the edge printing area including an outer area outside a recording sheet; and supplying the print data to a print execution machine, the print execution machine including a plurality of nozzles configured to eject ink droplets; a pressure applying section configured to apply pressure to ink to eject the ink droplets; and a drive section configured to supply a pulse signal to drive the pressure applying section, wherein the generating print data comprises determining a dot type from a plurality of dot types including a first type dot and second type dot, each of the dot formation states being classified into one of the plurality of dot types, wherein the first type dot is formed by a first process, the first process being for supplying the pressure applying section with a first drive pulse signal and an additional pulse signal subsequent to the first drive pulse signal, the first drive pulse signal being used to control one of the plurality of nozzles to eject an ink droplet, the additional pulse signal being used to apply pressure to the ink in the one of the plurality of nozzles in a direction opposite to an oscillating direction of a surface of the ink in the one of the plurality of nozzles, wherein the second type dot is formed by a second process, the second process being for supplying the pressure applying section with a second drive pulse signal without supplying the additional pulse signal, the second drive pulse signal being used to control the one of the plurality of nozzles to eject an ink droplet, wherein the determining determines that the first type dot is to be formed in the edge printing area, and wherein the determining determines that the first type dot is not to be formed but the second type dot is to be formed in the interior printing area.

2. The image processing apparatus according to claim 1, wherein the determining determines that the second type dot is not to be formed in at least a part of outer peripheral area of the edge printing area.

3. The image processing apparatus according to claim 1, wherein the first type dot is formed by ejecting N number of ink droplets from the one of the plurality of nozzles, where N is a natural number, wherein the second type dot is formed by ejecting M number of ink droplets from the one of the plurality of nozzles, where M is a natural number, wherein the N number of ink droplets are capable of reaching a point separated from the one of the plurality of nozzles by a specific distance that is larger than a distance between the recording sheet and the one of the plurality of nozzles, and wherein the M number of ink droplets are capable of reaching the recording sheet from the one of the plurality of nozzles and incapable of reaching the point.

4. The image processing apparatus according to claim 1, wherein the additional pulse signal has rectangular-shaped waveform.

5. The image processing apparatus according to claim 1, wherein each of the first drive pulse signal, the second drive pulse signal, and the additional pulse signal has rectangular-shaped waveform.

6. The image processing apparatus according to claim 1, wherein the generating print data further includes:

calculating a calibrated gradation value for a target pixel by using a gradation value of the target pixel and an error value concerning at least one pixel other than the target pixel; and determining dot formation state of the target pixel by comparing the calibrated gradation value with one of a plurality of threshold values, the plurality of threshold values being respectively correlated with the plurality of dot types, wherein the second type dot includes a first size dot having a first size, and a second size dot having a second size larger than the first size, wherein the plurality of threshold values including a first type threshold value and a second type threshold value, the first type threshold value being correlated with the first type dot, the second type threshold value includes a first size threshold value and a second size threshold value, the first size threshold value being correlated with the first size dot, the second size threshold value being correlated with the second size dot, the second size threshold value being larger than the first size threshold value, wherein the determining dot formation state of the target pixel compares the calibrated gradation value with the second size threshold value, with the first type threshold value, and with the first size threshold value, in stated order, wherein the first type threshold value is equal to the first size threshold value in at least a part of outer peripheral area of the edge printing area, and wherein the first type threshold value is equal to the second size value in the interior printing area.

7. The image processing apparatus according to claim 5, wherein the first drive pulse has a sign opposite to a sign of the additional pulse signal, and wherein the additional pulse signal starts within an interval when the surface of the ink moves in a direction toward exterior of the one of the plurality of nozzles from interior of the one of the plurality of nozzles.

8. The image processing apparatus according to claim 5, wherein the first drive pulse has a sign same as a sign of the additional pulse signal, and wherein the additional pulse signal starts within an interval when the surface of the ink moves in a direction toward interior of the one of the plurality of nozzles from exterior of the one of the plurality of nozzles.

9. The image processing apparatus according to claim 8, wherein the second type dot further includes a third size dot having a third size larger than the first size and smaller than the second size, wherein the second type threshold value includes a third size threshold value larger than the first size threshold value and smaller than the second size threshold value, the third size threshold value being correlated with the third size dot, wherein the determining dot formation state of the target pixel compares the calibrated gradation value with the second size threshold value, with the first type threshold value, with the third size threshold value, and with the first size threshold value, in stated order, and wherein the third size threshold value is equal to the first type threshold value in the at least a part of outer peripheral area of the edge printing area.

10. A non-transitory computer readable storage medium storing a set of program instructions installed on and executed by a computer, the set of program instructions comprising:

acquiring target image data;

generating print data using the target image data, the print data representing dot formation states for respective pixels in a printing area, the printing area including an edge printing area and an interior printing area inside the edge printing area, the edge printing area including an outer area outside a recording sheet; and supplying the print data to a print execution machine, the print execution machine including a plurality of nozzles configured to eject ink droplets; a pressure applying section configured to apply pressure to ink to eject the ink droplets; and a drive section configured to supply a pulse signal to drive the pressure applying section, wherein the generating print data comprises determining a dot type from a plurality of dot types including a first type dot and second type dot, each of the dot formation states being classified into one of the plurality of dot types, wherein the first type dot is formed by a first process, the first process being for supplying the pressure applying section with a first drive pulse signal and an additional pulse signal subsequent to the first drive pulse signal, the first drive pulse signal being used to control one of the plurality of nozzles to eject an ink droplet, the additional pulse signal being used to apply pressure to the ink in the one of the plurality of nozzles in a direction opposite to an oscillating direction of a surface of the ink in the one of the plurality of nozzles, wherein the second type dot is formed by a second process, the second process being for supplying the pressure applying section with a second drive pulse signal without supplying the additional pulse signal, the second drive pulse signal being used to control the one of the plurality of nozzles to eject an ink droplet, wherein the determining determines that the first type dot is to be formed in the edge printing area, and wherein the determining determines that the first type dot is not to be formed but the second type dot is to be formed in the interior printing area.

* * * * *